US012042099B2

(12) United States Patent
Kunda et al.

(10) Patent No.: US 12,042,099 B2
(45) Date of Patent: Jul. 23, 2024

(54) HORIZONTALLY ORIENTED PAPER PRODUCT DISPENSER AND RELATED METHODS

(71) Applicant: Essity Hygiene and Health Aktiebolag, Gothenburg (SE)

(72) Inventors: Catherine Hill Kunda, Wayne, PA (US); Magnus Falk, Gothenburg (SE); John P. Devlin, Tewksbury, MA (US); Peter McNulty, Seattle, WA (US); Jeffrey Mekler, San Francisco, CA (US)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 0 days.

(21) Appl. No.: 17/410,323

(22) Filed: Aug. 24, 2021

(65) Prior Publication Data

US 2021/0378462 A1 Dec. 9, 2021

Related U.S. Application Data

(62) Division of application No. 16/718,950, filed on Dec. 18, 2019, now Pat. No. 11,116,365.

(51) Int. Cl.
*A47K 10/24* (2006.01)

(52) U.S. Cl.
CPC ..... *A47K 10/24* (2013.01)

(58) Field of Classification Search
CPC .... A47K 10/24; A47K 10/426; A47K 10/427; A47K 2010/428; A47K 2010/3246
See application file for complete search history.

(56) References Cited

U.S. PATENT DOCUMENTS 340,355 A 4/1886 Ramser
744,047 A 11/1903 Casterline et al.
(Continued)

FOREIGN PATENT DOCUMENTS

CN 1168089 A 12/1997
CN 1257413 A 6/2000
(Continued)

OTHER PUBLICATIONS

Janet Beighle-French, New Products Ease Home Frustrations, Nov. 11, 1996, The Plain Dealer, Cleveland, Ohio, p. 7.D.
(Continued)

*Primary Examiner* — Gene O Crawford
*Assistant Examiner* — Kelvin L Randall, Jr.
(74) *Attorney, Agent, or Firm* — CANTOR COLBURN LLP

(57) ABSTRACT

A method for loading a stack of individual paper units into a dispenser includes inwardly pushing on a pair of oppositely disposed end portions of respective lateral walls of the dispenser, thereby releasing a drawer of the dispenser for sliding movement of that drawer relative to a remainder of the dispenser. The drawer includes first and second, oppositely disposed sidewalls, a bottom wall, and an arcuate front wall that has a dispensing aperture. The bottom wall of the drawer extends between the first and second sidewalls of the drawer, and the sidewalls of the drawer define an open end of the drawer opposite the bottom wall and, jointly with the bottom wall and arcuate front wall, defines a storage volume of the drawer. The drawer is slid outwardly relative to a remainder of the dispenser to thereby expose the first and second sidewalls and bottom wall of the drawer.

13 Claims, 21 Drawing Sheets

(56) References Cited

U.S. PATENT DOCUMENTS 777,082 A 12/1904 Cutler
832,284 A * 10/1906 White ..... E05C 19/06 4/267
1,111,962 A 9/1914 Hooper
1,114,354 A 10/1914 Hildebrand
1,151,064 A 8/1915 Swift
1,163,737 A 12/1915 Calvert
1,257,413 A 2/1918 Hill
1,333,045 A 3/1920 Swift
1,362,449 A 12/1920 Teall
1,503,241 A 7/1924 Horwitt
1,508,020 A 9/1924 Horwitt
1,513,792 A 11/1924 Arelt
1,563,078 A 11/1925 Erdos
1,703,594 A 2/1929 Pratt
1,752,885 A 4/1930 Carroll
1,784,836 A 12/1930 Hess
1,893,725 A 1/1933 Boomershine
1,898,983 A 2/1933 Wheeler, Jr.
1,901,243 A 3/1933 Horwitt
1,993,885 A 3/1935 Horwitt
2,081,564 A 5/1937 Tuszynski
2,092,166 A 9/1937 Kettles, Jr.
2,253,742 A 8/1941 West
2,337,065 A 12/1943 Price
2,354,058 A 7/1944 Ridgeway
2,426,136 A 8/1947 Agamaite
2,491,615 A 12/1949 Laid
2,689,059 A 9/1954 Nudell
2,765,909 A 10/1956 Graham
2,772,021 A 11/1956 Kettles
2,849,153 A 8/1958 Tuttle
2,876,884 A 3/1959 Hastie
2,932,426 A 4/1960 Hope et al.
3,028,047 A 4/1962 Tuft
3,117,694 A 1/1964 Gothreau
3,119,516 A 1/1964 Donovan
3,121,510 A 2/1964 Holzwarth
3,208,634 A 9/1965 Saxe
3,214,227 A 10/1965 Edwin
3,291,339 A 12/1966 Hein
3,425,595 A 2/1969 Shapira
3,425,685 A 2/1969 Liva
3,606,125 A 9/1971 Tucker et al.
3,608,891 A 9/1971 Hannon et al.
3,652,174 A 3/1972 Boone
3,674,175 A 7/1972 Jaquish
3,777,929 A 12/1973 Hannon et al.
3,777,931 A 12/1973 Fleming
3,785,523 A 1/1974 Goldstein
3,979,020 A 9/1976 Braber et al.
4,094,442 A 6/1978 Radek
4,118,085 A 10/1978 Fibus
4,143,792 A 3/1979 Rex
4,234,101 A 11/1980 Pastore
4,239,127 A * 12/1980 Owens ..... G07F 11/045 221/259
4,249,460 A 2/1981 McSwain
4,280,692 A 7/1981 Hutchinson et al.
4,311,252 A 1/1982 Hope, Jr. et al.
4,329,001 A 5/1982 Filipowicz et al.
4,364,488 A * 12/1982 Anjou ..... A24F 27/00 220/345.3
4,372,549 A 2/1983 Stiernspetz
4,401,210 A * 8/1983 Anjou ..... B65D 11/12 220/345.3
4,413,749 A 11/1983 Glaser
4,416,392 A 11/1983 Smith
4,494,948 A 1/1985 Teyssier, Jr.
4,526,291 A 7/1985 Margulies
D282,574 S 2/1986 Case et al.
4,638,921 A 1/1987 Sigl et al.
4,662,536 A 5/1987 Powers
4,838,454 A * 6/1989 Salzmann ..... A47K 10/427 312/61
4,919,377 A 4/1990 Alexander et al.
4,938,382 A 7/1990 Frazier et al.
4,953,747 A 9/1990 Wenkman et al.
D310,923 S 10/1990 Breger
4,969,575 A 11/1990 Kobayashi
5,011,010 A 4/1991 Francis et al.
5,076,466 A * 12/1991 Petterson ..... A47K 10/427 312/61
5,082,229 A 1/1992 Dahl
5,090,592 A 2/1992 Petterson et al.
5,100,020 A 3/1992 Petterson et al.
5,102,007 A 4/1992 Petterson et al.
5,123,566 A 6/1992 Lage et al.
5,131,561 A 7/1992 Casperson et al.
5,190,186 A 3/1993 Yablans et al.
5,199,599 A 4/1993 Shade
5,222,628 A 6/1993 Roethel
5,261,557 A 11/1993 Bytell et al.
5,269,409 A 12/1993 Brandt et al.
5,348,356 A * 9/1994 Moulton ..... E05B 37/20 292/87
5,356,032 A 10/1994 Rhodes
5,513,773 A 5/1996 Cargill
5,515,999 A 5/1996 Jo
5,535,320 A 7/1996 Gay et al.
5,540,353 A * 7/1996 Coleman ..... B65D 83/0409 221/24
5,586,685 A 12/1996 Dorner et al.
5,616,113 A 4/1997 Van Den Bergh
5,630,581 A 5/1997 Rodesch
5,632,409 A 5/1997 Raghunanan
5,638,962 A 6/1997 Price, Jr.
5,678,728 A 10/1997 Leto
5,690,230 A 11/1997 Griffith
5,743,605 A 4/1998 Marino
5,813,569 A 9/1998 Cihanek
5,823,344 A 10/1998 Fantone et al.
5,823,353 A 10/1998 Perrin et al.
5,857,791 A 1/1999 Kenney
5,865,340 A 2/1999 Alvern
5,894,931 A 4/1999 Dunn
5,908,137 A 6/1999 Pattarozzi
6,003,723 A 12/1999 Morand
6,056,133 A 5/2000 Luenser
6,145,231 A 11/2000 Valiulis
6,230,929 B1 5/2001 Phelps et al.
6,257,443 B1 7/2001 LaCount
6,286,713 B1 9/2001 Chan et al.
6,331,696 B1 12/2001 Nakamura et al.
6,334,544 B1 1/2002 Christensen et al.
6,354,462 B1 3/2002 Conran et al.
6,378,726 B1 4/2002 Chan et al.
6,386,389 B1 5/2002 Percy et al.
6,427,838 B1 8/2002 Fulda
6,440,052 B1 8/2002 Reider et al.
D463,184 S 9/2002 Tramontina et al.
6,457,605 B2 10/2002 Coleman
6,519,885 B2 2/2003 Valiulis
6,542,641 B1 4/2003 Andrew et al.
6,543,643 B2 4/2003 Iida et al.
6,592,118 B2 7/2003 Youn
6,655,544 B1 12/2003 Tanaka et al.
6,704,616 B2 3/2004 Formon
6,705,473 B1 3/2004 Schlesinger
6,726,014 B2 4/2004 Laurent
6,772,908 B2 8/2004 Roethel et al.
6,783,411 B2 8/2004 Pither
6,789,694 B1 9/2004 Mccullough
6,824,007 B2 11/2004 Timmers et al.
6,830,151 B2 12/2004 Spencer et al.
6,871,755 B2 3/2005 DeVries et al.
6,874,653 B2 4/2005 Boone et al.
6,892,898 B1 5/2005 Boone et al.
6,929,147 B2 8/2005 Guillemette et al.
6,964,349 B2 11/2005 Sears et al.
6,981,610 B2 1/2006 Smiley et al.
6,988,635 B2 1/2006 Hochtritt et al.

(56) References Cited

U.S. PATENT DOCUMENTS 7,048,143 B2 * 5/2006 Sanders ..... A47K 10/422 221/46
D524,084 S 7/2006 Wieser et al.
7,093,737 B2 8/2006 Tramontina et al.
7,124,911 B2 10/2006 Tramontina et al.
7,134,571 B2 11/2006 Hochtritt et al.
7,178,689 B2 2/2007 Wieser et al.
7,219,852 B2 5/2007 Tramontina et al.
7,234,610 B2 6/2007 Skarda et al.
7,370,860 B2 5/2008 James, III et al.
7,503,780 B1 * 3/2009 Huang ..... H01R 13/4538 439/135
7,543,423 B2 6/2009 Long et al.
7,661,553 B2 2/2010 Zeiron
7,721,913 B2 5/2010 Nash et al.
7,837,057 B2 11/2010 Zeiron
7,922,035 B2 * 4/2011 Long ..... B65H 45/24 221/48
7,938,294 B2 5/2011 Cittadino et al.
8,328,046 B2 12/2012 Hochtritt et al.
D675,851 S 2/2013 Wilson
D692,730 S 11/2013 Wilson, Jr. et al.
8,590,738 B2 11/2013 Formon et al.
D701,434 S 3/2014 Wilson, Jr.
D705,015 S 5/2014 Wilson, Jr. et al.
D705,016 S 5/2014 Wilson, Jr. et al.
D705,017 S 5/2014 Siebel
8,757,432 B2 6/2014 Muntzing et al.
8,863,984 B2 10/2014 Siebel
8,881,943 B2 11/2014 Kobayashi
D729,541 S 5/2015 Wilson, Jr.
D740,049 S 10/2015 Wilson, Jr.
D745,336 S 12/2015 Rittfeldt et al.
D745,337 S 12/2015 Rittfeldt et al.
9,345,368 B2 * 5/2016 Formon ..... A47K 10/44
9,433,331 B2 9/2016 Siebel
9,609,763 B2 * 3/2017 Gerst ..... E05C 19/06
9,622,627 B2 4/2017 Wilson et al.
9,901,221 B2 2/2018 Larsson et al.
9,901,222 B2 2/2018 Wilson et al.
9,986,876 B2 6/2018 Brickl et al.
10,004,366 B2 6/2018 Chalko et al.
10,083,566 B1 9/2018 McPake
10,405,705 B2 9/2019 Formon et al.
10,602,890 B2 3/2020 Billman et al.
10,799,424 B2 * 10/2020 Knobel ..... A61J 1/1425
2001/0020624 A1 9/2001 Hubanks et al.
2002/0030061 A1 3/2002 Formon
2002/0070228 A1 6/2002 Moody
2002/0139813 A1 10/2002 Boone et al.
2002/0179624 A1 * 12/2002 Tramontina ..... A47K 10/427 221/33
2003/0019880 A1 1/2003 Timmers et al.
2003/0057221 A1 3/2003 Guillemette et al.
2003/0062375 A1 4/2003 Christensen et al.
2003/0071050 A1 4/2003 Clark
2003/0080137 A1 5/2003 Clark et al.
2003/0116580 A1 6/2003 Baughman
2003/0146240 A1 8/2003 Kawolics
2004/0007586 A1 1/2004 Boone et al.
2004/0050857 A1 3/2004 Norton
2004/0055903 A1 * 3/2004 Nishimura ..... A45C 11/14 206/1.5
2004/0178648 A1 9/2004 Moses
2004/0178948 A1 9/2004 Axelsson
2004/0222582 A1 11/2004 Widlund
2005/0056656 A1 3/2005 Hochtritt et al.
2005/0150898 A1 * 7/2005 Young ..... A47K 10/427 221/44
2005/0199643 A1 * 9/2005 Smiley ..... A47K 10/427 221/63
2006/0027590 A9 2/2006 Tramontina et al.
2006/0076357 A1 4/2006 Braat et al.
2006/0086748 A1 4/2006 Burns
2006/0089034 A1 * 4/2006 Chen ..... H05K 5/06 439/164
2006/0102641 A1 5/2006 Cittadino
2006/0102642 A1 5/2006 Muntzing et al.
2006/0169712 A1 8/2006 Mtzchaki
2006/0273100 A1 12/2006 Cittadino et al.
2006/0273101 A1 12/2006 Lewis et al.
2006/0273102 A1 12/2006 Wieser et al.
2007/0034638 A1 * 2/2007 Zeiron ..... A47K 10/427 221/52
2007/0152010 A1 7/2007 Denen et al.
2007/0215634 A1 9/2007 Levin
2008/0113855 A1 5/2008 Gooding, Jr.
2008/0135570 A1 6/2008 Lee
2008/0142536 A1 6/2008 Cohen et al.
2009/0212150 A1 8/2009 Wruck, Jr. et al.
2009/0266837 A1 * 10/2009 Gelardi ..... B65D 50/046 221/282
2009/0272755 A1 11/2009 Burns
2009/0277920 A1 11/2009 Cittadino et al.
2010/0114366 A1 5/2010 Case et al.
2010/0224647 A1 9/2010 Formon et al.
2010/0274384 A1 10/2010 Nordlund et al.
2011/0067363 A1 * 3/2011 Sprada ..... B65D 83/0463 220/23.91
2011/0095042 A1 4/2011 Bandoh
2011/0132920 A1 6/2011 Petocchi
2011/0174834 A1 7/2011 Case
2013/0161346 A1 6/2013 Wolme et al.
2013/0256163 A1 * 10/2013 Cottle ..... B65D 50/04 206/265
2014/0014675 A1 1/2014 Ingvarsson et al.
2014/0116913 A1 * 5/2014 Thorburn ..... B65D 65/10 206/494
2014/0319164 A1 * 10/2014 Wilson ..... A47K 10/422 221/45
2015/0031257 A1 1/2015 Ootsubo
2016/0029857 A1 2/2016 Woerpel et al.
2016/0051100 A1 2/2016 Formon et al.
2016/0088982 A1 3/2016 Larsson et al.
2016/0090229 A1 * 3/2016 Stenberg ..... B65D 85/62 428/189
2018/0354667 A1 * 12/2018 Wallenius ..... B65D 85/07

FOREIGN PATENT DOCUMENTS

CN 1327427 A 12/2001
CN 2528370 Y 1/2003
CN 2546386 4/2003
CN 1593318 3/2005
CN 1678228 10/2005
CN 1767779 5/2006
CN 101014272 8/2007
CN 101186075 5/2008
CN 101331063 12/2008
CN 101983027 3/2011
CN 102368941 3/2012
CN 202376008 8/2012
DE 19514431 A1 11/1995
EP 1238619 A2 9/2002
EP 1656870 5/2006
EP 1693304 8/2006
EP 2335541 6/2011
EP 2850985 3/2015
FR 1285715 A 2/1962
FR 2538695 A1 7/1984
FR 2551964 A1 3/1985
FR 2732579 A1 10/1996
GB 2357080 A 6/2001
SE 0301297 B 5/1968
WO 0189354 A1 11/2001
WO 2004093629 11/2004
WO 2005107546 11/2005
WO 2005107548 11/2005
WO 2006132618 12/2006
WO 2006132696 12/2006

(56) References Cited

FOREIGN PATENT DOCUMENTS

| | | | | |
|---|---|---|---|---|
| WO | 2013055340 | | 4/2013 | |
| WO | 2018054455 | | 3/2018 | |
| WO | WO-2018192636 | A1 * | 10/2018 | ..... A47K 10/424 |

OTHER PUBLICATIONS

Joel Palmer, Rolling Meadows parks pursues deal with Pepsi bottler, Sep. 24, 1997, Chicago Daily Herald, News; p. 4.
Plasticrafters Website, Displays2Go.com, Jan. 11, 2002, p. 1-2.

* cited by examiner

HORIZONTALLY ORIENTED PAPER PRODUCT DISPENSER AND RELATED METHODS

CROSS-REFERENCE TO RELATED APPLICATIONS

The present application is a Divisional application of co-pending U.S. Ser. No. 16/718,950, filed Dec. 18, 2019, which is related to U.S. Ser. No. 16/719,087, now U.S. Pat. No. 10,980,377, and the disclosures of which are hereby incorporated by reference herein in their entireties.

TECHNICAL FIELD

The present disclosure is generally related to dispensers and, more particularly, to dispensers of paper product and methods for dispensing such paper product.

SUMMARY

In one embodiment, a method is disclosed for loading a stack of individual paper units into a dispenser. The method includes inwardly pushing on a pair of oppositely disposed end portions of respective lateral walls of the dispenser, to thereby release a drawer of the dispenser for sliding movement of that drawer relative to a remainder of the dispenser. The drawer includes first and second, oppositely disposed sidewalls, a bottom wall, and also an arcuate front wall that has a dispensing aperture. The bottom wall of the drawer extends between the first and second sidewalls of the drawer, and the sidewalls of the drawer define an open end of the drawer opposite the bottom wall and, jointly with the bottom wall and arcuate front wall, defines a storage volume of the drawer. The method further includes outwardly sliding the drawer relative to a remainder of the dispenser to thereby expose the first and second sidewalls and the bottom wall of the drawer.

A stack of interfolded paper units is inserted into the storage volume of the drawer through the open end of that drawer such that one of a plurality of side faces of the stack rests on the bottom wall of the drawer. The method includes longitudinally supporting the stack with inwardly protruding portions of one or both of the sidewalls of the drawer to thereby hinder pivotal movement of paper units of the stack in a direction away from the arcuate front wall of the drawer.

The drawer is then slid inwardly relative to a remainder of the dispenser to cause a paper-engaging surface of a platen of the dispenser to engage the back surface of the stack and exert an outwardly-directed force against the stack toward the arcuate front wall. The paper-engaging surface of the platen is maintained in a substantially constant oblique orientation relative to the bottom wall of the drawer, with that oblique orientation being substantially the same as an orientation of a plane circumscribing respective top and bottom junctures of the arcuate front wall with the sidewalls of the drawer. A portion of an individual paper unit from the front face of the stack is extended through the dispensing aperture of the arcuate front wall of the drawer to thereby dispense that individual paper unit.

The method may further include urging the platen outwardly, toward the arcuate front wall of the drawer, by means of a biasing element that is coupled to that platen. In specific embodiments, the front face of the stack includes a first pair of surface edges that are parallel to one another, and a second pair of surface edges orthogonal to the first pair of surface edges, with the first and second pairs of surface edges jointly defining a perimeter of the front face of the stack. In those specific embodiments, the front face of the stack further includes a linear gripping tab that is generally parallel to the first pair of surface edges and which extends between the second pair of surface edges.

The dispensing aperture of the arcuate front wall may have an elongated shape and include a length dimension and a width dimension, with the method further including orienting the stack in the storage volume of the drawer such that the linear gripping tab is orthogonal to the length dimension of the dispensing aperture. The dispensing aperture, in some embodiments, has a centrally located section and a pair of slotted sections on each side of the centrally located section, with the width of the dispensing aperture in the centrally located section being greater than the width of the dispensing aperture in each of the slotted sections, and with the method further including orienting the stack in the storage volume of the drawer such that the gripping tab is located within the centrally located section. Each of the slotted sections may have a width no greater than about 13 mm, and/or the centrally located section may have a width of less than about 30 mm, and/or the centrally located section may have a length that is no greater than about 40 mm.

Inserting the stack into the storage volume of the drawer may include inserting a stack that has a height no greater than about 110 mm, and a number of individual paper units that is no greater than about 120. The individual paper units may be interfolded. The stack being inserted may be one of at least two stacks being inserted into the storage volume of the drawer, and the method may include interleaving individual paper units of the first and second stacks with one another prior to inwardly sliding the drawer relative to the remainder of the dispenser. Alternatively, the method may include inserting a second stack of individual paper units substantially identical to the first stack into the storage volume of the drawer, and inwardly sliding the drawer relative to the remainder of the dispenser without interleaving individual paper units of the first and second stacks with one another. A portion of an individual paper unit from the front face of the second stack may be extended through the dispensing aperture of the front wall of the drawer, to thereby dispense that individual paper unit from the second stack. In specific embodiments, extending a portion of an individual paper unit from the front face of the second stack includes pinching a linear gripping tab on the front face of the second stack through a centrally located section of the dispensing aperture of the arcuate front wall.

In another embodiment, a napkin dispenser is provided that includes a plurality of outer walls, and an end wall extending between those outer walls, with those outer walls and end wall jointly defining a close-ended, generally tubular structure. The dispenser includes a drawer that has a pair of sidewalls, a bottom wall extending between the sidewalls, and a front wall having a dispensing aperture and joining the sidewalls and bottom wall, with the sidewalls, bottom wall, and front wall jointly defining a storage volume of the drawer, and with that drawer being configured for releasable coupling with the tubular structure and further configured for selective slidable movement into and out of the tabular structure. A platen is disposed in the drawer, and has a paper-engaging surface for engaging a stack of napkins that is stored in the storage volume of the drawer. The dispenser also includes a biasing element, coupled to the platen, that is configured to urge the platen toward the front wall, with the platen being disposed in the drawer so as to maintain the paper-engaging surface in a substantially constant orientation that is oblique relative to the bottom wall of the drawer during slidable movement of the drawer relative to the tubular structure.

Additionally or alternatively, the sidewalls of the drawer may include a plurality of tabs disposed along a top region of the sidewalls for supporting the stack of napkins and hinder pivotal movement of the stack, with a remainder of each of the sidewalls being free of tabs. The end wall may have an arcuate outer surface that is configured to cause the dispenser to wobble if the dispenser is stood on that arcuate outer surface. The arcuate outer surface may be shaped so as to cause the dispenser to wobble only along one dimension. In specific embodiments, the front wall of the drawer is arcuate, and the substantially constant oblique orientation of the paper-engaging surface relative to the bottom wall is substantially the same as an orientation of a plane circumscribing respective top and bottom junctures of that arcuate front wall with the sidewalls. The oblique orientation of the paper-engaging surface may for example be such that same defines an angle of about 105 degrees relative to the bottom wall of the drawer.

In yet another embodiment, a napkin dispenser is provided that includes a plurality of outer walls, a front wall that extends between the outer walls and that has a dispensing aperture, and an end wall that is disposed opposite the front wall. The outer walls, front wall, and end wall jointly define a storage volume of the dispenser for storing a stack of napkins therein. The dispensing aperture is shaped to permit extraction of napkins from the stack in the storage volume, and the end wall has an arcuate outer surface that is configured to cause the dispenser to wobble if the dispenser is stood on that arcuate outer surface. The arcuate outer surface may be shaped to cause the dispenser to wobble only along one dimension if the dispenser is stood on that arcuate outer surface. The arcuate outer surface may have a radius of curvature greater than about 350 degrees, for example.

In another embodiment, a napkin dispensing system is provided that includes a dispenser for storing and dispensing individual napkins from a stack of those napkins, and a stack of interfolded napkins. The dispenser has a plurality of outer walls and an end wall extending between those outer walls, with those walls jointly defining a close-ended generally tubular structure. The dispenser has a drawer that includes a pair of sidewalls, a bottom wall extending between the sidewalls, and a front wall joining the sidewalls and bottom wall, with those sidewalls, bottom wall, and front wall jointly defining a storage volume of the drawer, the drawer being configured for releasable coupling with the tubular structure and configured also for selective slidable movement into and out of the tubular structure.

The dispenser of the napkin dispensing system in that embodiment further includes a platen disposed in the drawer, and which has a paper-engaging surface for engaging a stack of napkins stored in the storage volume of the drawer. A biasing element is coupled to the platen and is configured to urge the platen toward the front wall. The platen is disposed in the drawer so as to maintain the paper-engaging surface in a substantially constant orientation that is oblique relative to the bottom wall of the drawer during slidable movement of the drawer relative to the tubular structure. The system includes a stack of interfolded napkins in the storage volume of the drawer. The stack has a rectangular footprint that includes a length not exceeding about 115 mm and a width not exceeding about 95 mm. The front wall of the dispenser includes an elongated dispensing aperture that has a length dimension and a width dimension. The dispensing aperture has a centrally located section and a pair of slotted sections each extending from that centrally located section. The centrally located section has a length no greater than about 40 mm and the slotted sections each have a width no greater than about 13 mm.

In another embodiment, a napkin dispensing system is provided that includes a dispenser for storing and dispensing individual napkins from a stack of those napkins, and a stack of interfolded ones of such napkins. The dispenser has a plurality of outer walls, a front wall that extends between the outer walls and which includes a dispensing aperture, and an end wall that is disposed opposite the front wall, with the outer walls, front wall, and end wall jointly defining a storage volume of the dispenser for storing the stack of napkins therein. The dispensing aperture is shaped to permit extraction of napkins from the stack in the storage volume one at a time. The stack of interfolded napkins is disposed in the storage volume of the dispenser, and the stack has a generally rectangular footprint, with that footprint including a length that does not exceed about 115 mm, and a width that does not exceed about 95 mm. The end wall of the dispenser has an arcuate outer surface that is configured to cause the dispenser to wobble if the dispenser is stood on that arcuate outer surface.

BRIEF DESCRIPTION OF THE DRAWINGS

The objectives and features of the invention will become more readily apparent from the following detailed description taken in conjunction with the accompanying drawings in which.

DETAILED DESCRIPTION OF PARTICULAR EMBODIMENTS

To the extent that any meaning or definition of a term in this written document conflicts with any meaning or definition of the term in a document incorporated by reference, the meaning or definition assigned to the term in this written document shall govern. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. Also, as used herein, the term "releasable coupling" and related terms refer to a type of coupling in which the coupled structures may be readily detached, decoupled, or otherwise separated from one another in a simple manner and without causing the destruction or damage of any of those structures. For sake of further explanation, a permanent—rather than "releasable"—type of coupling may refer, for example, to two structures that are integrally formed with one another, or which are adhesively attached, such that their separation would necessarily result in at least some level of damage to one or more of the parts being separated. In addition, as used herein, the terms "top," "bottom," "front," "back," "side," "lateral," and derivatives thereof refer to the relative positions of structural elements in the illustrative orientation in the figures, and are therefore not intended to be limiting.

Figure 1:
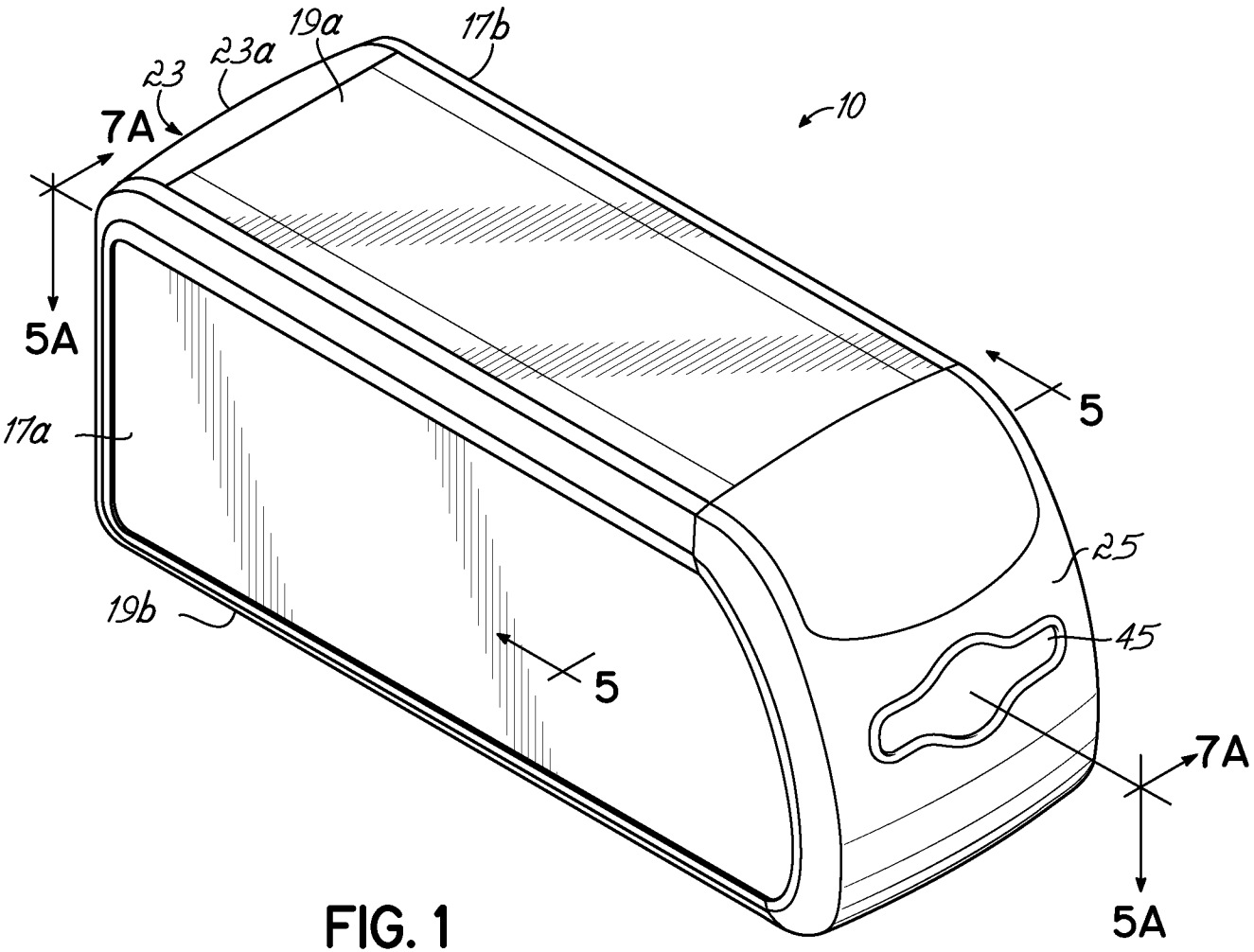
FIG. 1 is a perspective view of a dispenser for storing and dispensing individual paper units from a stack of such paper units in accordance with one embodiment of the invention.
Figure 2:
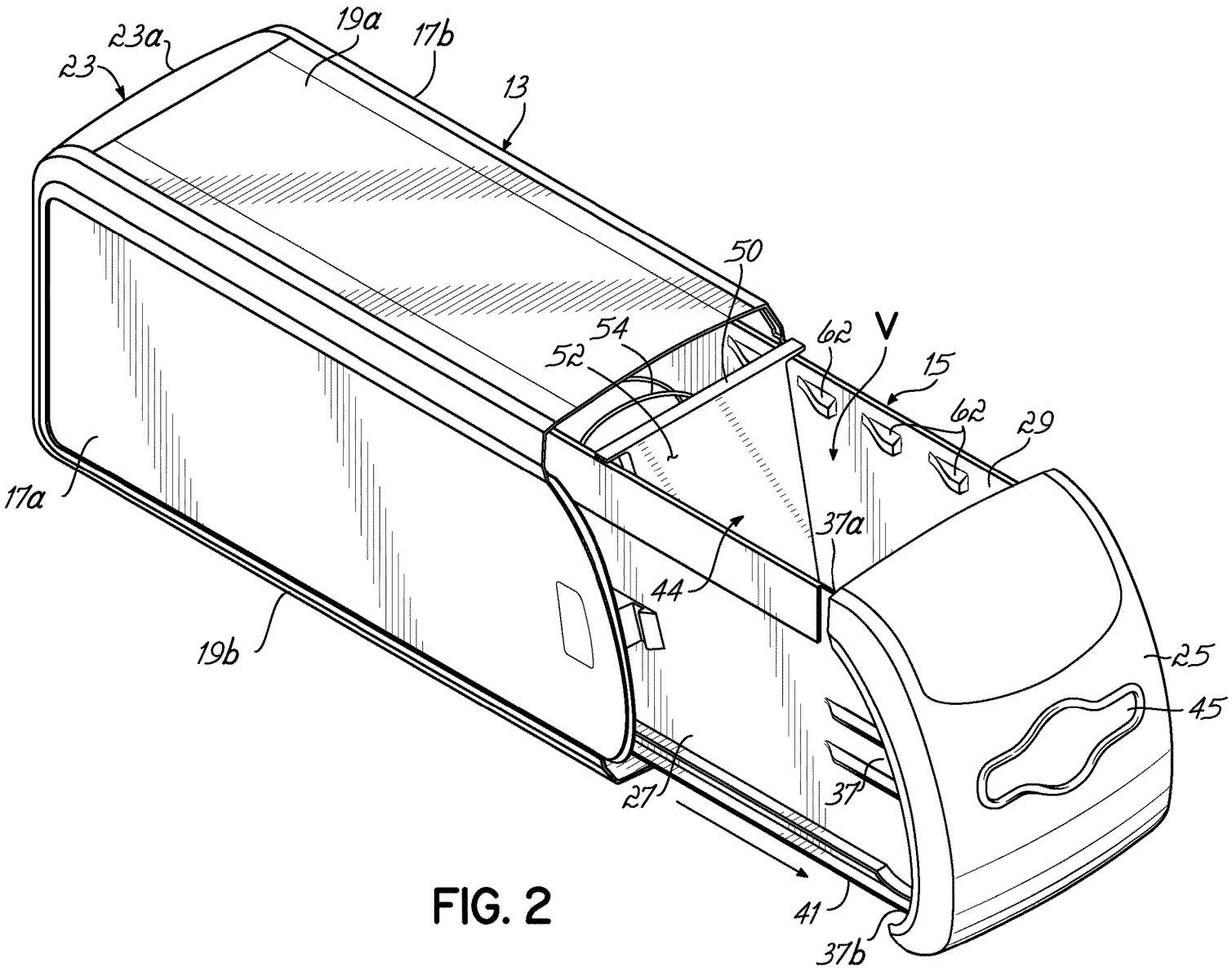
FIG. 2 is a perspective view of the dispenser of FIG. 1, showing a drawer of that dispenser in an open position.
Figure 3:
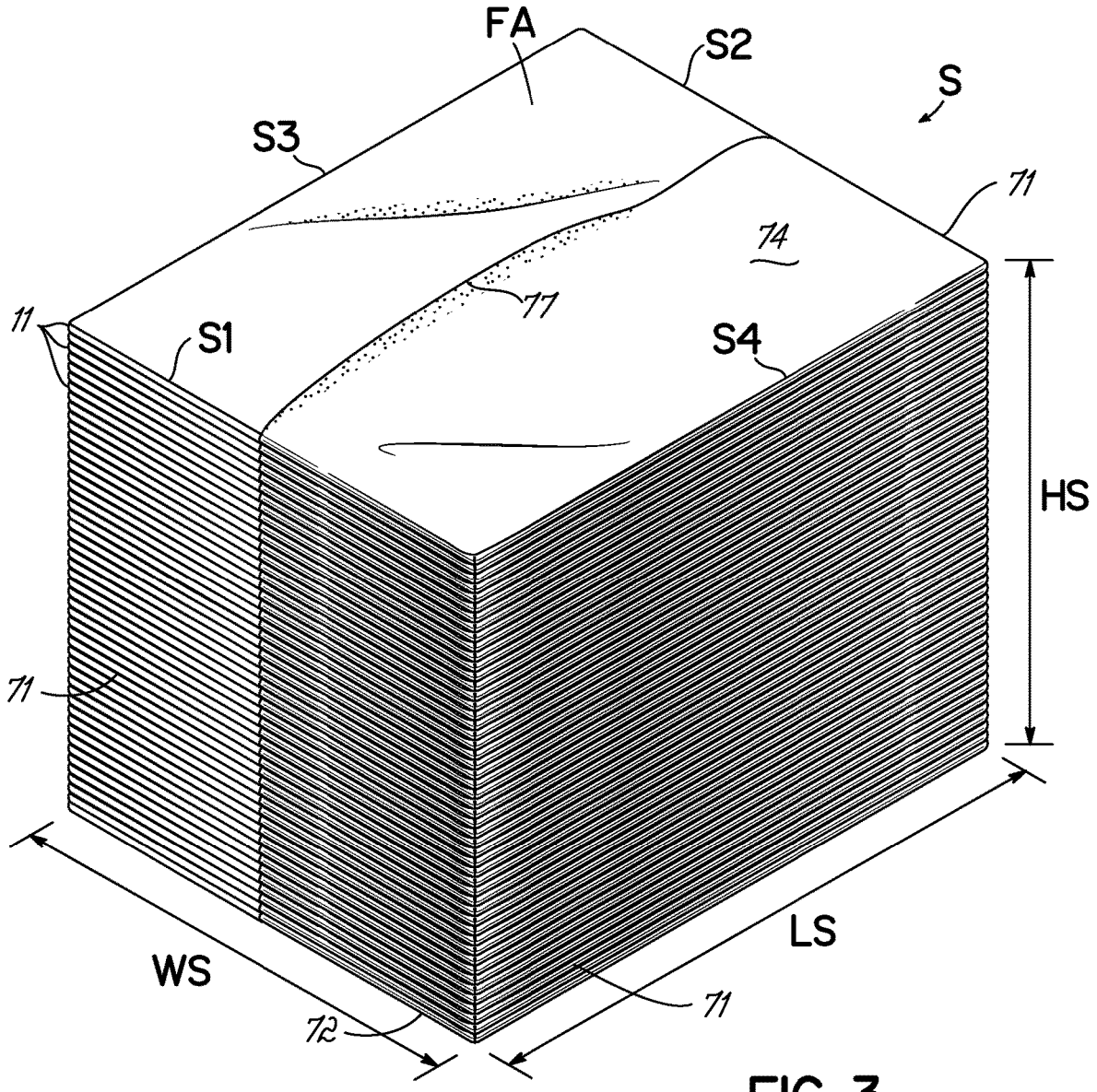
FIG. 3 is a perspective view of a stack of individual paper units in accordance with one embodiment of the invention.
Figure 4:
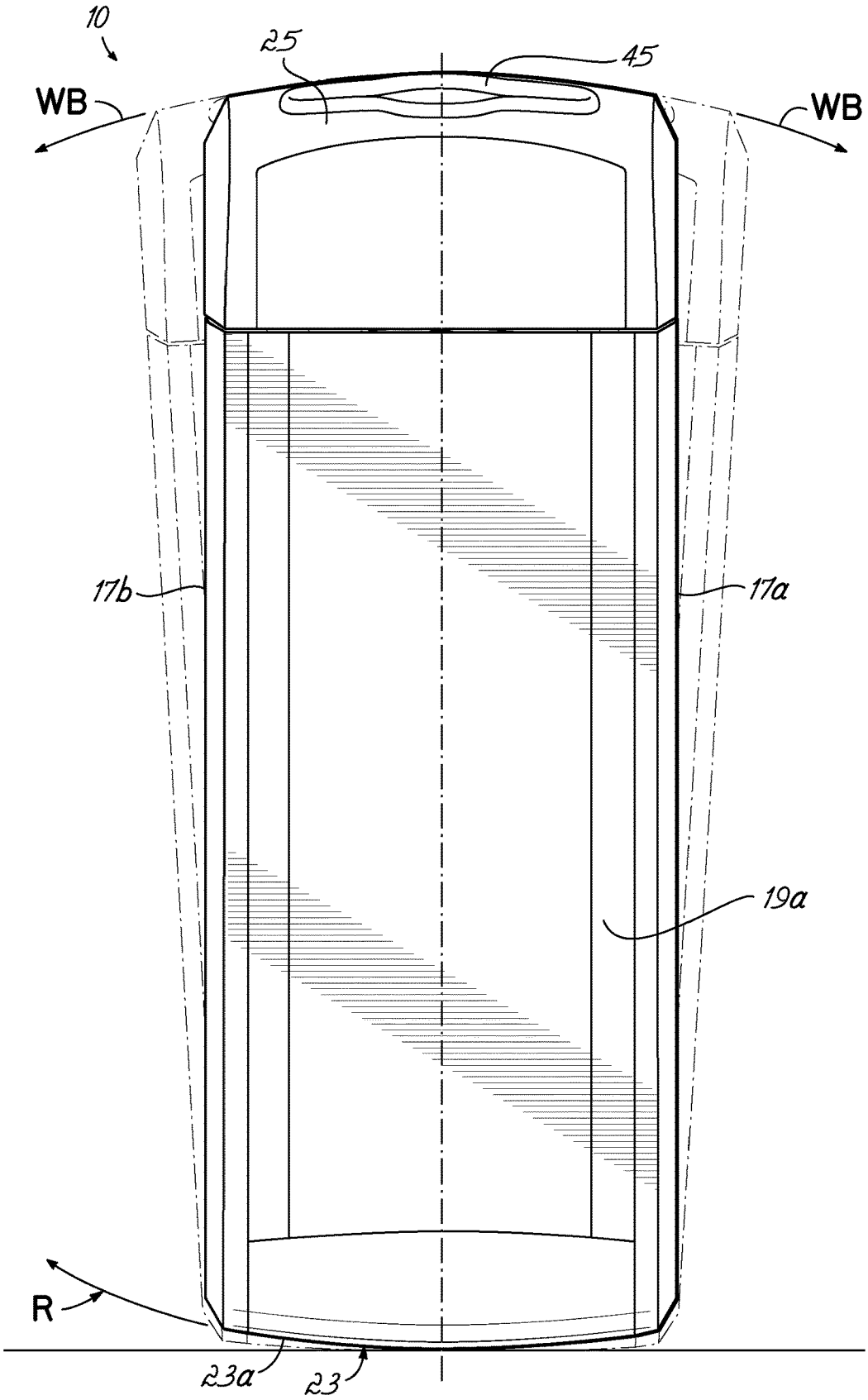
FIG. 4 is an elevation view of the dispenser of FIGS. 1 and 2, stood on an end thereof.
Figure 5:
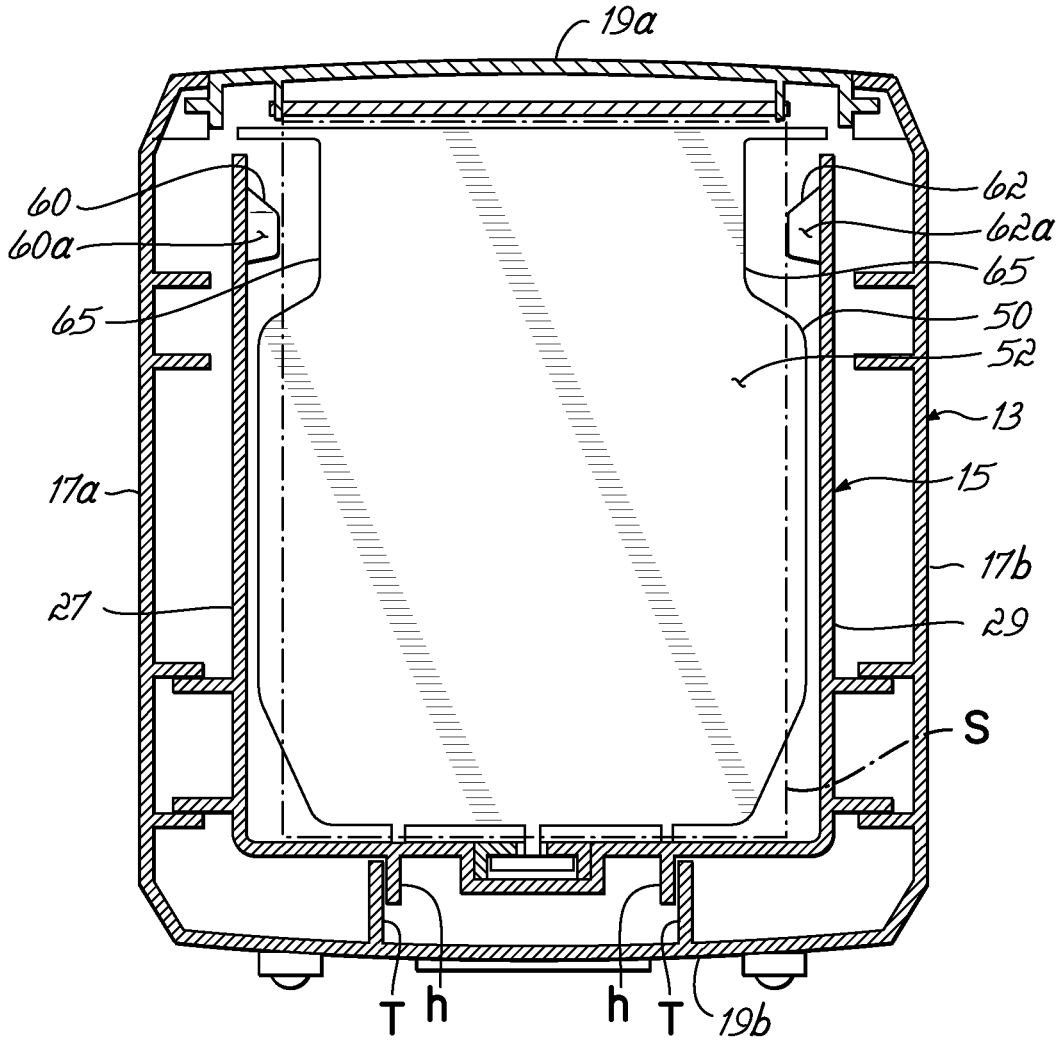
FIG. 5 is a cross-sectional view taken generally along line 5-5 of FIG. 1.

With reference to the figures, and more particularly to FIGS. 1, 2, 3, 4, 5, 5A, 5B, and 5C, an illustrative apparatus in the form of a dispenser 10 is shown for dispensing individual paper units such as napkins 11 from a stack S of those napkins 11 (FIG. 3). While the description herein refers to the individual paper units as napkins, it is contemplated that other types of paper units such as facial tissue or hand towel sheets may be used in the manner described herein and are therefore considered to fall within the scope of the present disclosure. As shown particularly in FIGS. 1 and 2, dispenser 10 is made up of a close-ended, generally tubular outer structure or casing 13 that is releasably coupled to a drawer 15 for selective sliding movement of that drawer 15 between a fully closed position (FIG. 1) and an open position (FIG. 2) of that drawer 15. Sliding movement of drawer 15 is provided by a pair of rails h of drawer 15 that ride along a cooperating slotted track T of casing 13, as seen in FIG. 5.

Casing 13 is made up of a plurality of outer walls that include a pair of oppositely disposed lateral walls 17*a*, 17*b*, and a pair of oppositely disposed top and bottom outer walls 19*a*, 19*b*, as well as an end wall 23 that extends between the lateral, top, and bottom outer walls 17*a*, 17*b*, 19*a*, 19*b*. Drawer 15, in turn, is made up of an arcuate front wall 25 that also defines a front wall of the dispenser 10, as a whole, and a pair of oppositely disposed sidewalls 27, 29 each joined to the front wall 25 along juncture areas 37, 39 (FIG. 2). Each of the juncture areas 37, 39, includes respective top and bottom junctures 37*a*, 37*b* and 39*a*, 39*b* at the highest and lowest points of juncture of the sidewalls 27, 29 with front wall 25 (FIG. 5C). Drawer 15 also includes a bottom wall 41 that extends between the sidewalls 27, 29 of drawer 15. The sidewalls 27, 29 define an open end 44 of drawer 15 and, jointly with the bottom wall 41, define a storage volume V of dispenser 10, and particularly of drawer 15, which is configured to receive and store napkins 11 in stack form, for dispensing of those napkins 11 through an elongate dispensing aperture 45 forming part of front wall 25.

As seen in the figures, outward sliding movement of drawer 15 from the fully closed position (FIG. 1) to an open position (FIG. 2) is effective to expose the sidewalls 27, 29 and the bottom wall 41 of drawer 15, thereby permitting the loading of one or more full or partial stacks S of napkins 11 into the storage volume V, by inserting such full or partial stacks S through open end 44, as more fully explained below. It is contemplated that, in use, dispenser 10 may be supported in any desired orientation, such as the generally horizontal orientation illustrated in FIGS. 1 and 2. In embodiments in which it is desired for the dispenser to be supported in the particular example orientation of those figures, however, an exterior surface 23*a* of end wall 23 may be shaped so as to be arcuate.

The example curved or arcuate exterior surface 23*a* in FIGS. 1 and 2 is effective to cause the dispenser 10 to wobble if stood on that exterior surface 23*a*, as shown in FIG. 4, for example. Further, in that specific example embodiment, wobbling of the dispenser 10 is only configured to occur along a single dimension, such as side-to-side, as indicated by arrows WB, which may be desirable for a more controlled wobbling movement of dispenser 10 than in embodiments in which wobbling may occur along multiple dimensions. The instability of dispenser 10 when stood on exterior surface 23*a* is effective to dissuade an end user of that dispenser 10 from standing that dispenser on its end (i.e., on end wall 23), thereby forcing the end user to rest the dispenser on bottom outer wall 19*b* instead, as shown in FIGS. 1 and 2. The generally horizontal example orientation of FIGS. 1 and 2 may be desired in order to control the action of gravity on the various moving parts of dispenser 10, which in turn guarantees proper operation of that dispenser 10.

Arcuate surface 23*a* may have a detrimental effect on the perception of value of the dispenser 10, as opposed to a surface that is planar (e.g., flat). Specifically, users of dispenser 10 may incorrectly assume that same is deformed, by virtue of the non-flat (i.e., non-planar) nature of surface 23*a*. In dispenser embodiments having an arcuate surface 23*a*, as illustrated, the radius of curvature R of surface 23*a* may be about 350 degrees or greater. The inventors have found that a radius of curvature of about 350 degrees or greater causes the dispenser 10 to gently wobble if stood on end wall 23, but with little (if any) chance of toppling over, which thereby minimizes the likelihood of damaging the internal components of dispenser 10. The radius of curvature, accordingly, may be for example about 387 degrees. It is understood that a radius of curvature that is substantially larger than 387 degrees (thereby approaching a planar shape for surface 23*a*) would lose the wobbling effect described above. Conversely, a radius of curvature R that is substantially smaller than 350 degrees may make the dispenser 10 undesirably unstable if stood on end 23.

With continued reference to FIGS. 1-4, and 5A-5C, and further referring to FIGS. 6, 6A, 7A, 7B, 7C, 7D, 7E, 7F, 7G, and 7H, dispenser 10 includes a platen 50 that includes a paper-engaging surface 52, and which supports the stack S of napkins 11 in storage volume V. Platen 50 urges the stack S in storage volume V toward the dispensing aperture 45 of front wall 25. To that end, platen 50 is urged outwardly (i.e., toward front wall 25) by a biasing element, in the form—in this example embodiment—of a compression spring 54, that is coupled at one end to an interior surface 23*b* of end wall 23 and at the other end to an underside 56 of platen 50. It is contemplated that other types of biasing elements may be used instead of compression spring 54, such as a leaf spring or another type of spring, or some other element having resilient properties (e.g., a compressible rubber ball).

Figure 6:
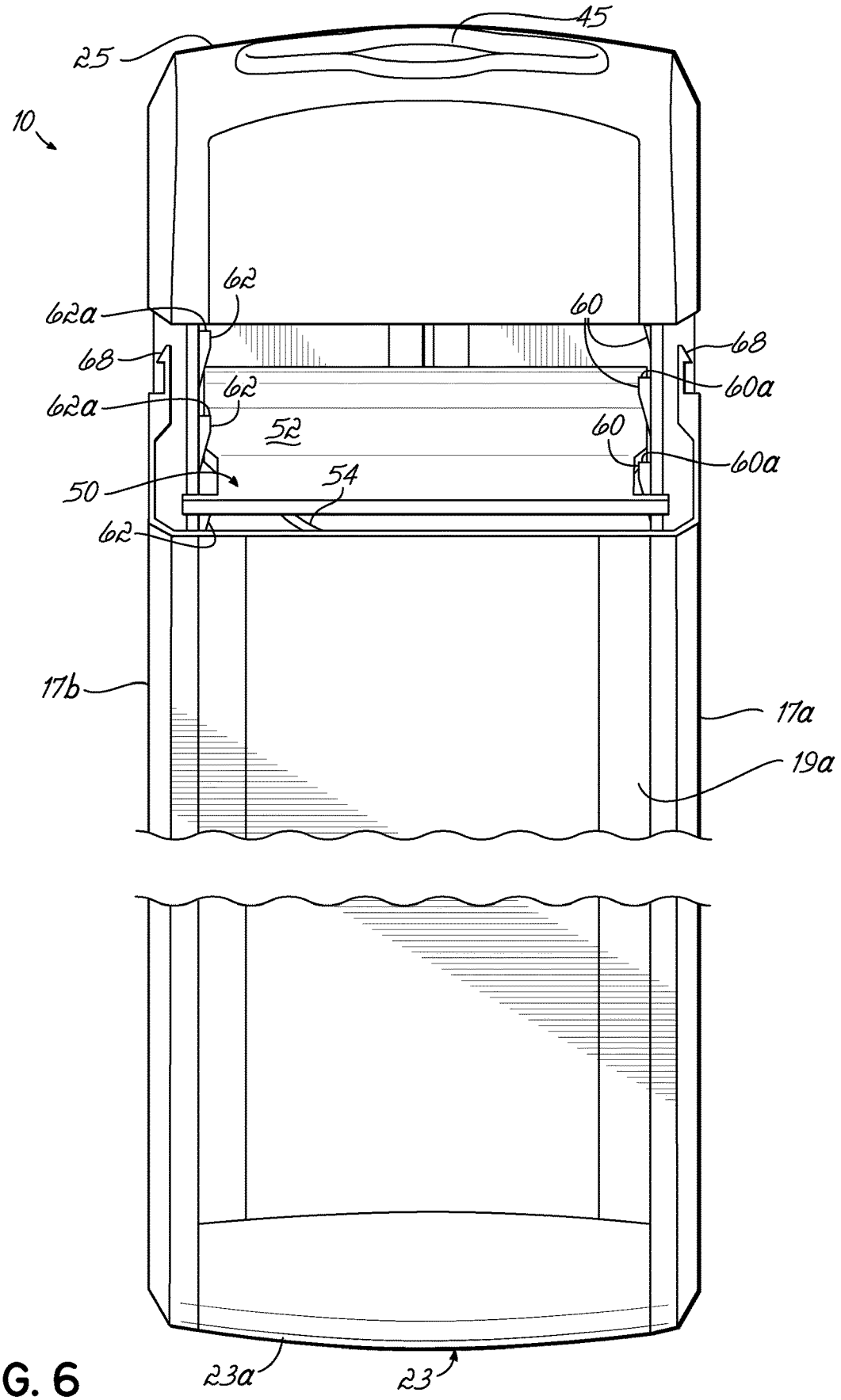
FIG. 6 is a broken away top view of the dispenser of FIGS. 1 and 2, with the drawer in an open position.
Figure 6A:
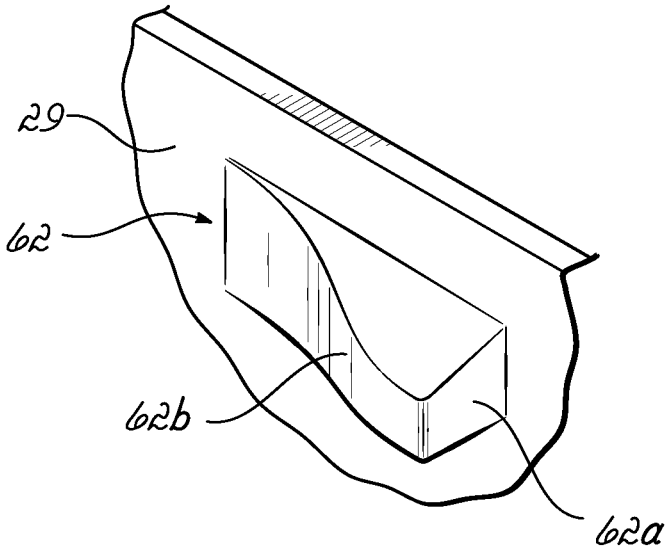
FIG. 6A is a perspective view of a support tab or rib of the dispenser of FIGS. 1 and 2.

In addition, and as shown particularly in FIGS. 6 and 6A, dispenser 10 includes first and second plurality of longitudinally spaced-apart, inwardly protruding ribs or tabs 60, 62 respectively on each of the sidewalls 27, 29, and which facilitate the loading of stacks S of napkins 11 into storage volume V. As used herein, the term "longitudinal" and derivatives thereof refer to the dimension associated with the length of the dispenser 10 i.e., the dimension that extends between the front wall 25 and the end wall 23. Tabs 60, 62 are located only along a top section of the sidewalls 27, 29 and are disposed such that the tabs 60 on sidewall 27 are offset in the longitudinal dimension with respect to the tabs 62 on the opposite sidewall 29, thereby attaining a staggered configuration. The remainder of sidewalls 27, 29, or at least the sections of sidewalls 27, 29 adjacent bottom wall 41, are free of tabs 60, 62 or any such other structure that may interfere with movement of platen 50 along the length of drawer 15. Each of the tabs 60, 62 protrudes toward the center of the storage volume V and includes a support surface 60*a*, 62*a*, generally facing the front wall 25 and configured to provide back-support (i.e., in the longitudinal direction of dispenser 10) to the stack S, particularly during loading of stack S. Further, each of the tabs 60, 62 includes a slanted surface 60*b*, 62*b* that generally faces the end wall 23, and which is shaped so as to permit substantially unhindered forward movement (i.e., toward front wall 25) of the stack S for dispensing of napkins 11 of that stack S. As seen in FIG. 5, platen 50 has respective notches 65 that allow forward (i.e., toward front wall 25) and backward (i.e. toward end wall 23) travel of platen 50 without interference by the tabs 60, 62.

Figure 5B:
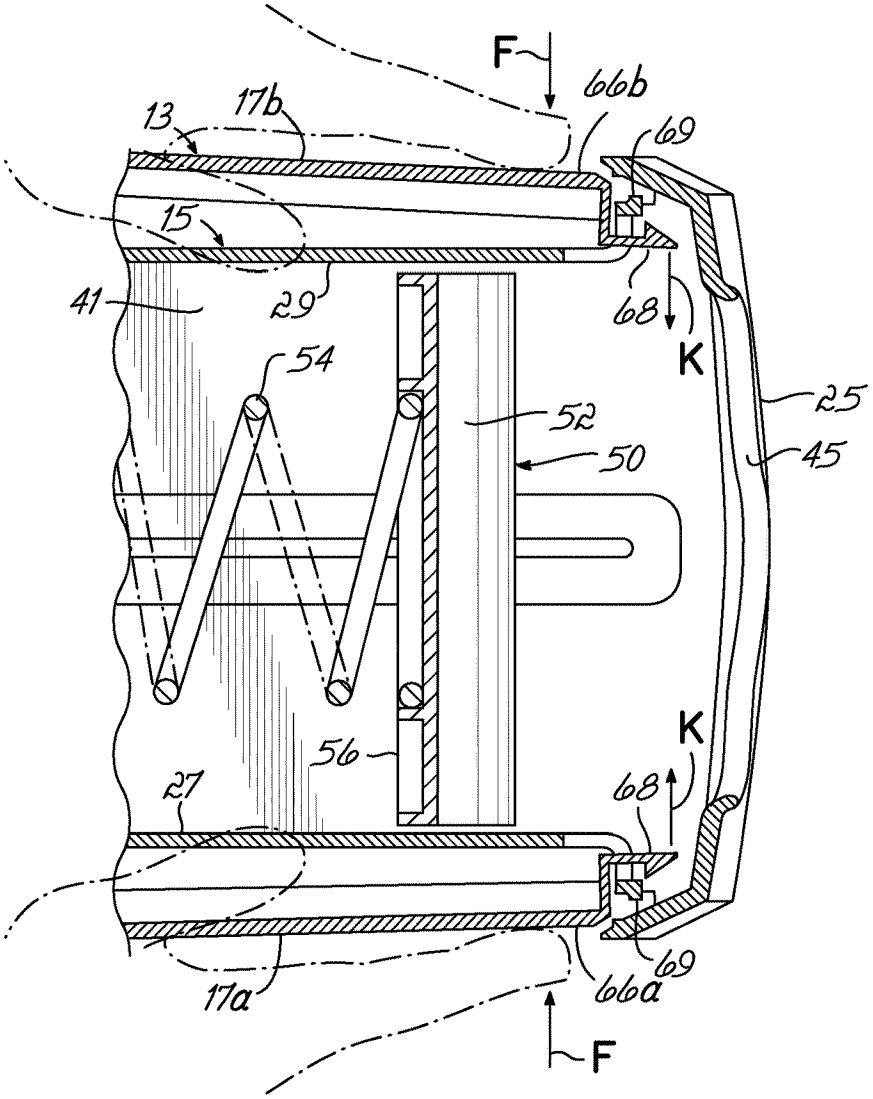
FIG. 5B is a view similar to FIG. 5A, showing part of a method for disengaging the drawer from a casing of the dispenser.
Figure 5A:
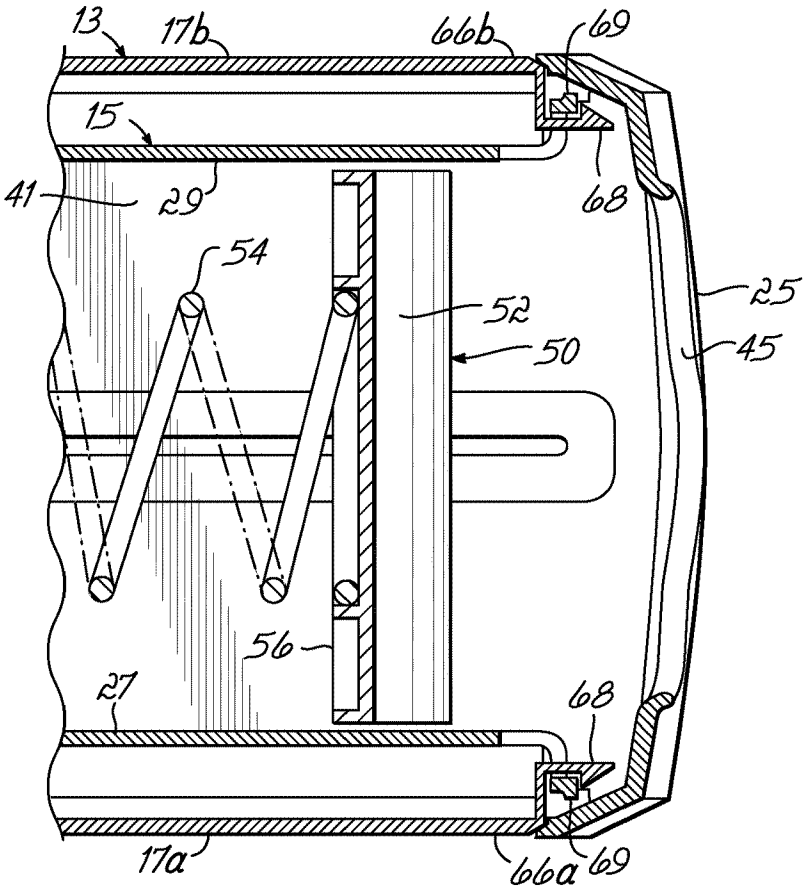
FIG. 5A is a top, cross-sectional view, of a front portion of the dispenser of FIGS. 1 and 2.
Figure 5C:
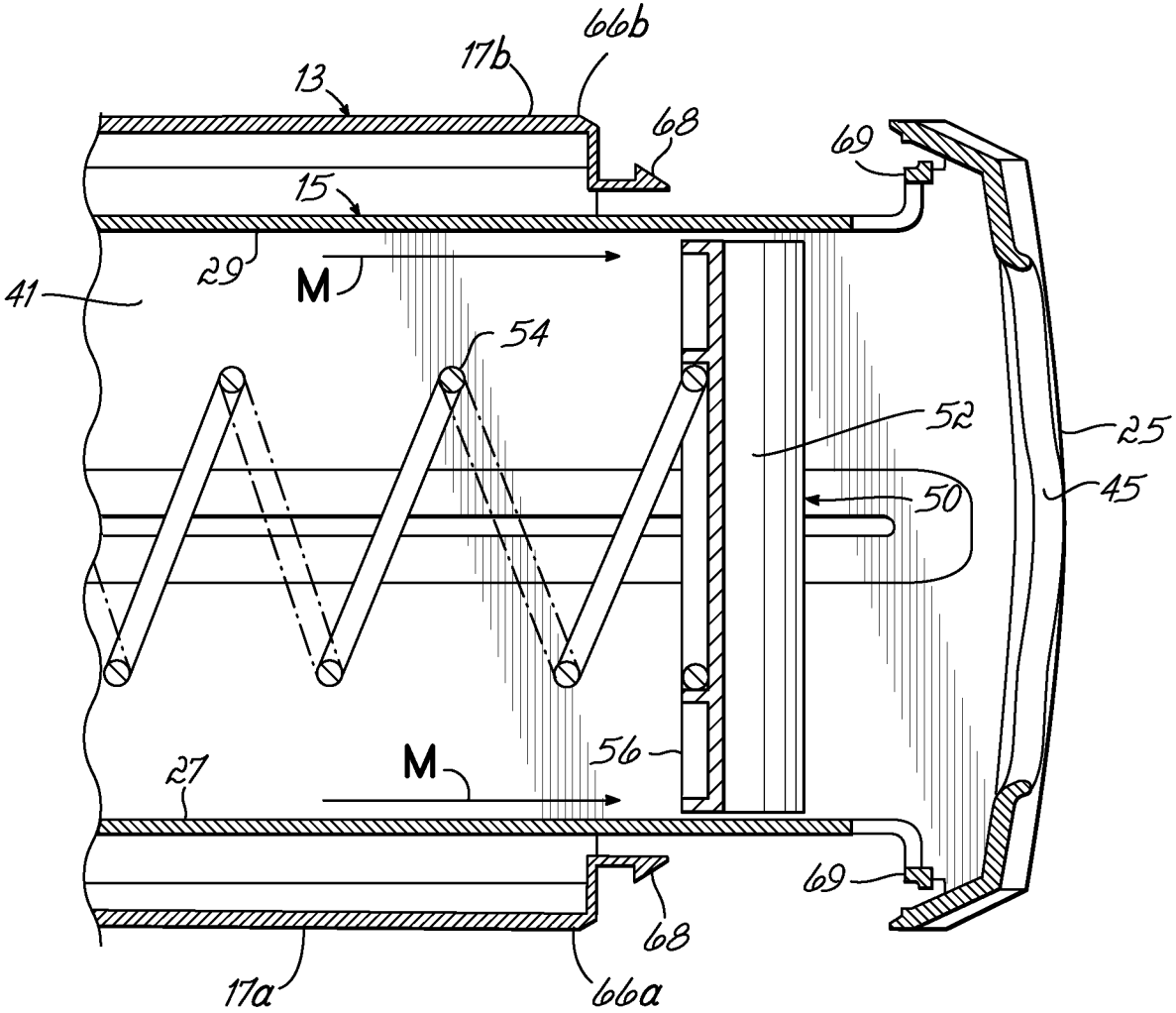
FIG. 5C is a view similar to FIGS. 5A and 5B, showing sliding movement of the drawer relative to the casing of the dispenser.
Figure 7A:
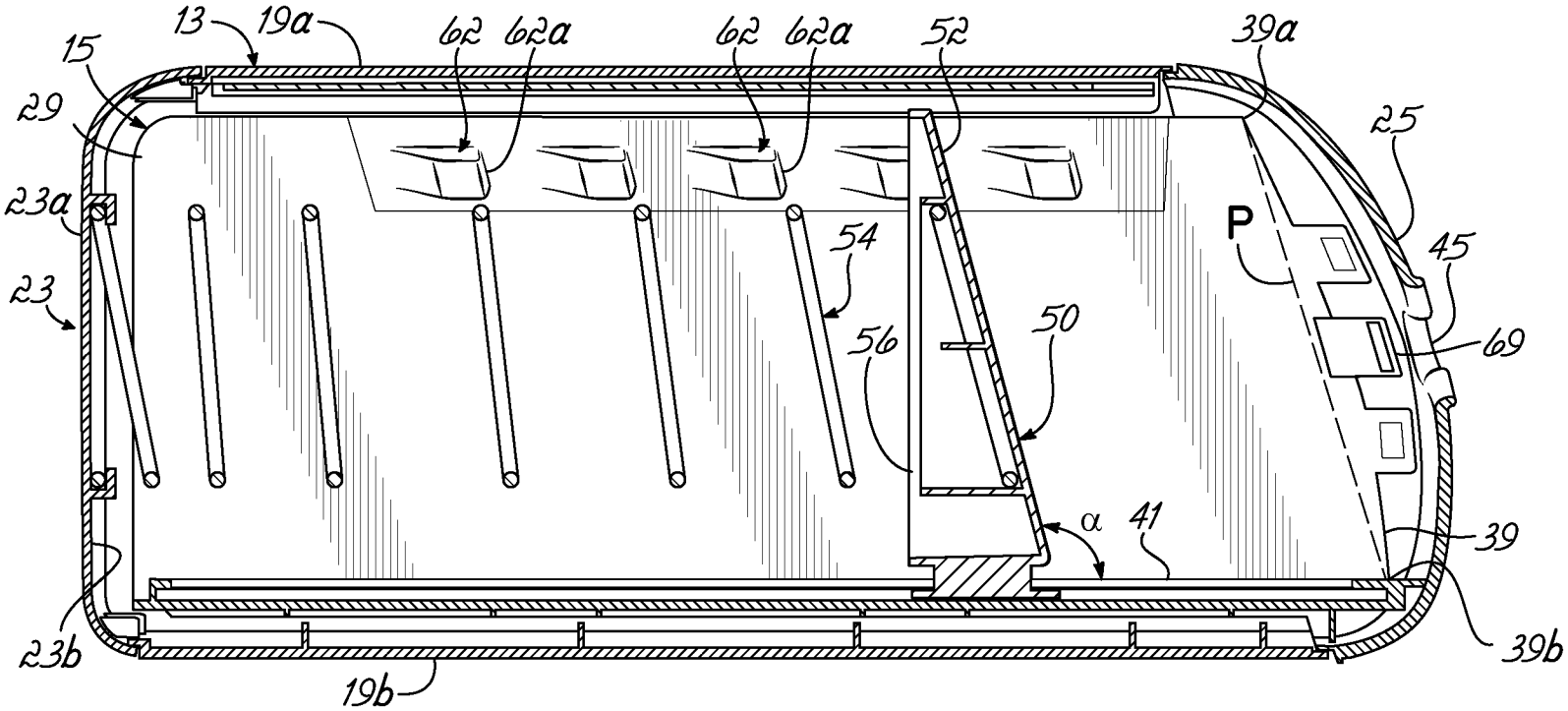
FIG. 7A is cross-sectional view taken generally along line 7A-7A of FIG. 1.
Figure 7B:
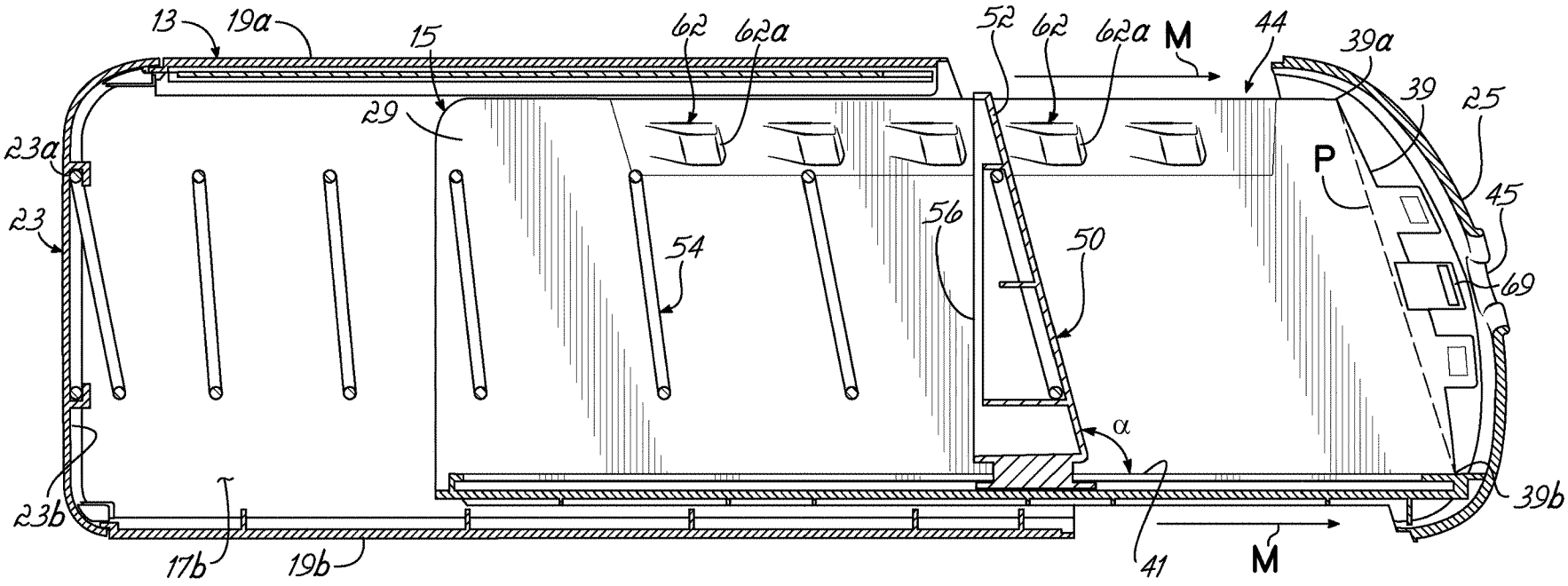
FIG. 7B is a view similar to FIG. 7A, showing the drawer in an open position.
Figure 7C:
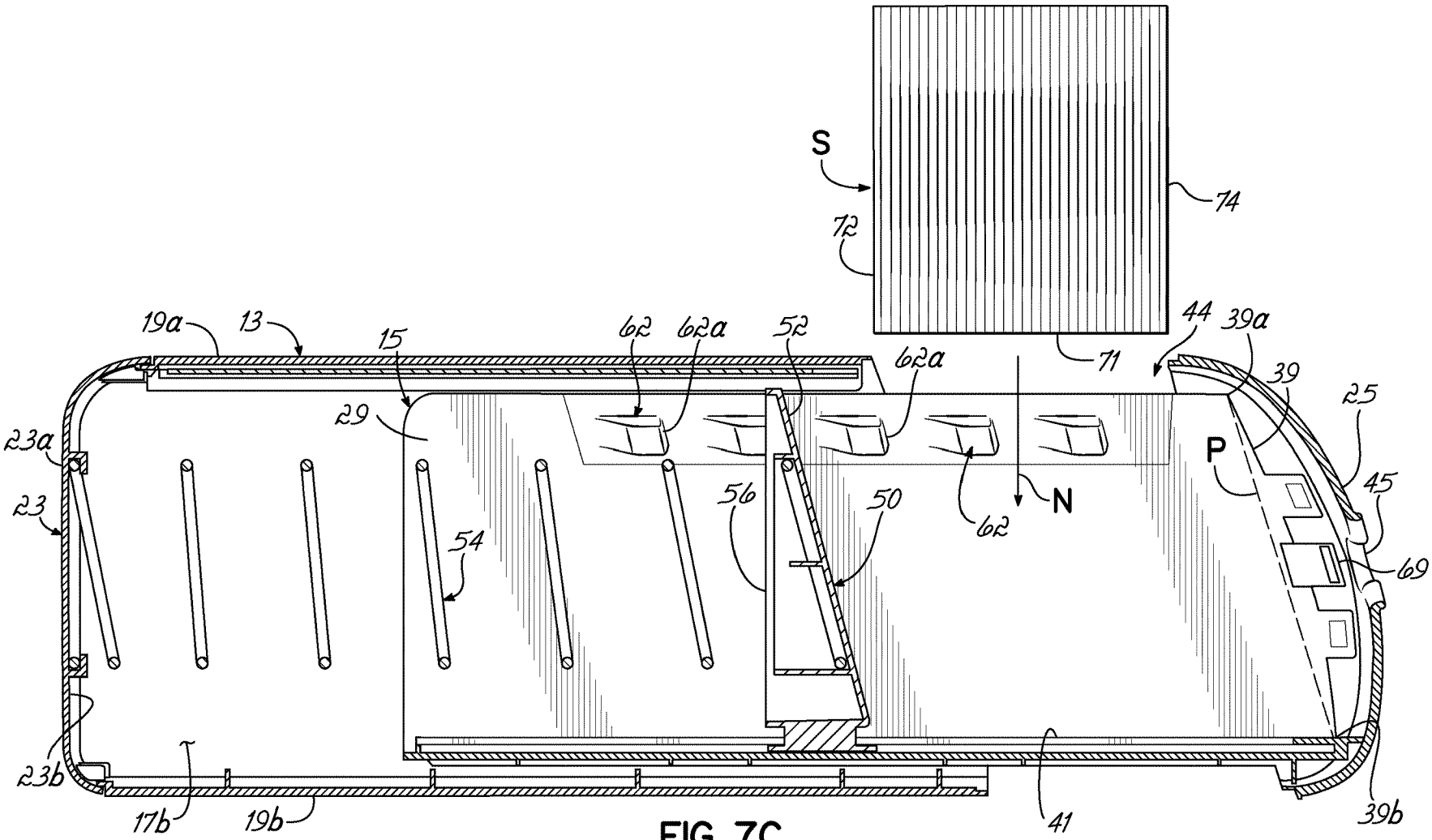
FIG. 7C is a view similar to FIGS. 7A and 7B, showing part of a method for loading a stack of napkins into the dispenser.
Figure 7D:
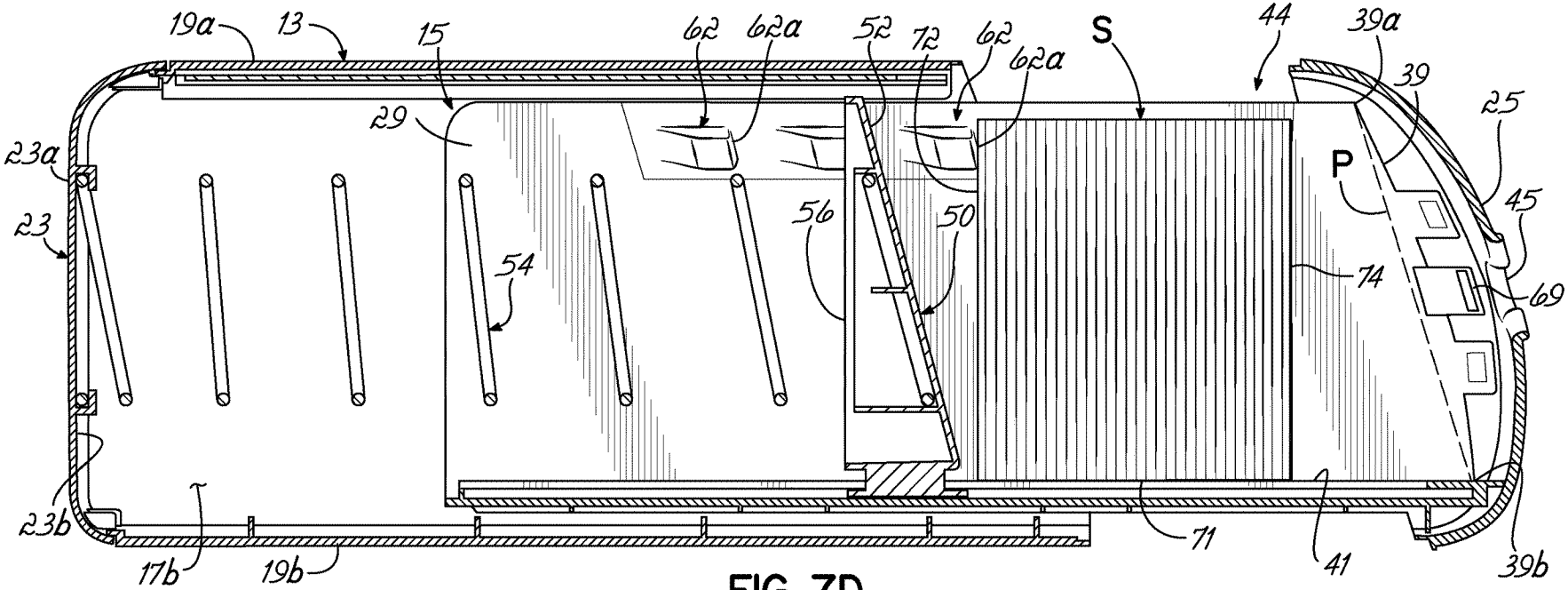
FIG. 7D is a view similar to FIGS. 7A-7C, showing another part of a method for loading a stack of napkins into the dispenser.

FIGS. 5A-5C and 7A-7H illustrate a contemplated process for loading a stack S of napkins 11 into the storage volume V of dispenser 10. FIGS. 5A and 7A show drawer 15 in a closed position relative to casing 13. The person loading the napkins 11 in preparation for dispensing (hereinafter "the user") proceeds to inwardly push on a pair of end portions 66*a*, 66*b* of the lateral walls 17*a*, 17*b* of casing 13, respectively, as shown in FIG. 5B (arrows F). The force exerted by the user is effective to disengage a pair of hooks 68 of the sidewalls 27, 29 from a cooperating pair of locking tabs 69 of front wall 25 (arrows K), thereby releasing the drawer 15 to permit sliding movement of drawer 15 relative to casing 13, and particularly for forward (i.e., outward) sliding movement of that drawer 15 (arrows M), as shown in FIGS. 5C and 7B. As seen in those figures, outward sliding movement of drawer 15 exposes sidewalls 27, 29, as well as the bottom wall 41 to the exterior of dispenser 10. The user then proceeds to load a stack S of napkins (in the general direction of arrow N) into storage volume V through open end 44 of drawer 15 (FIGS. 7C and 7D).

Loading of the stack S includes orienting the stack S sideways i.e., such that the bottom wall 41 of drawer 15 faces one of the side faces 71 of the stack S and such that a back surface or face 72 (or alternatively a front surface or face 74) of the stack S faces the end wall 23 of dispenser 10. The stack S is disposed in storage volume V such that the side face 71 facing bottom wall 41 rests on that bottom wall 41, and further such that a top portion of the back face 72, adjacent open end 44, is back-supported, in the longitudinal direction of dispenser 10, by the tabs 60, 62. More specifically, the back face 72 of stack S is positioned in storage volume V in a manner that causes engagement of a top portion of that back face 72 with support surfaces 60*a*, 62*a* of tabs 60, 62. That engagement prevents tilting motion (i.e., pivotal motion) of the stack S away from front wall 25, which thereby facilitates substantially maintaining the sideways and upright orientation of stack S without relying on back-supporting (i.e., longitudinally supporting) of the stack S by platen 50, and without relying on back-supporting (in the longitudinal direction of dispenser 10) of the stack S by the user's hand. This, in turn, frees up the user's hands for other parts of the loading operation and may even facilitate a single-handed loading operation of stack S into dispenser 10.

Figure 7E:
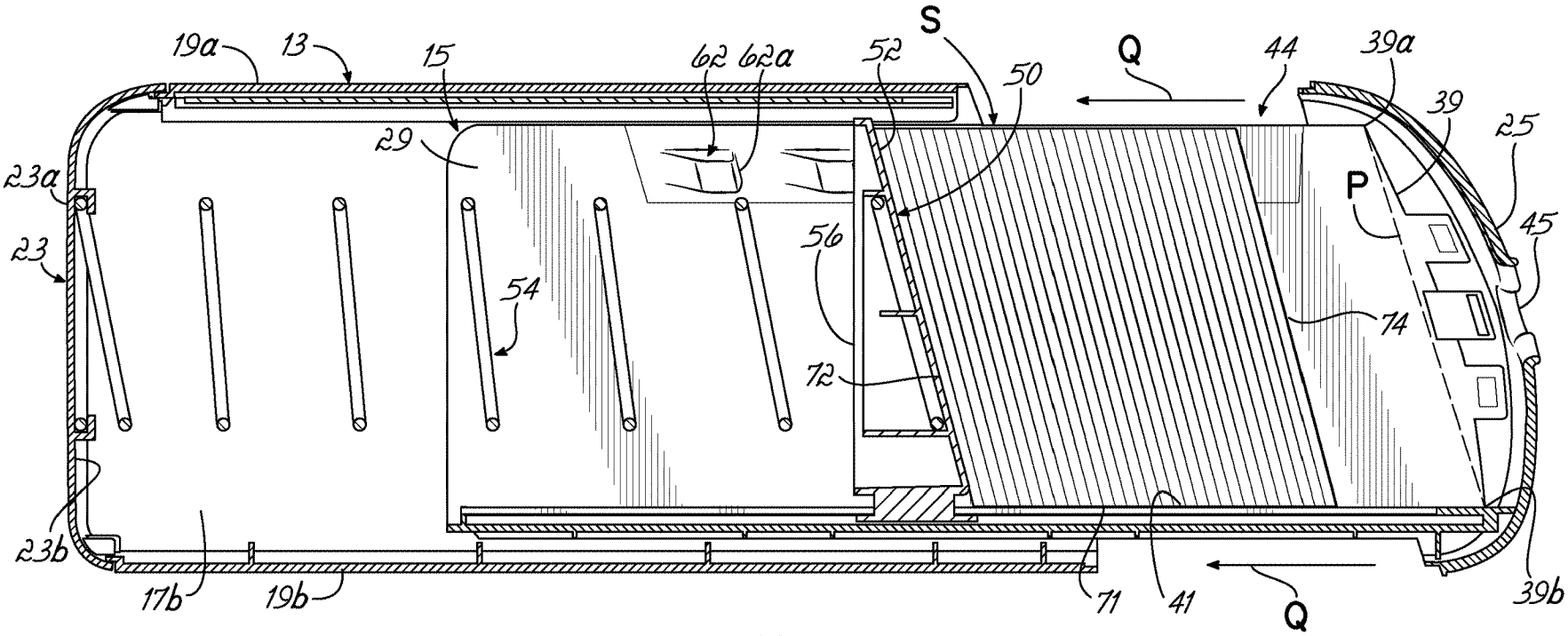
FIG. 7E is a view similar to FIGS. 7A-7D, showing the drawer sliding toward the closed position.
Figure 7F:
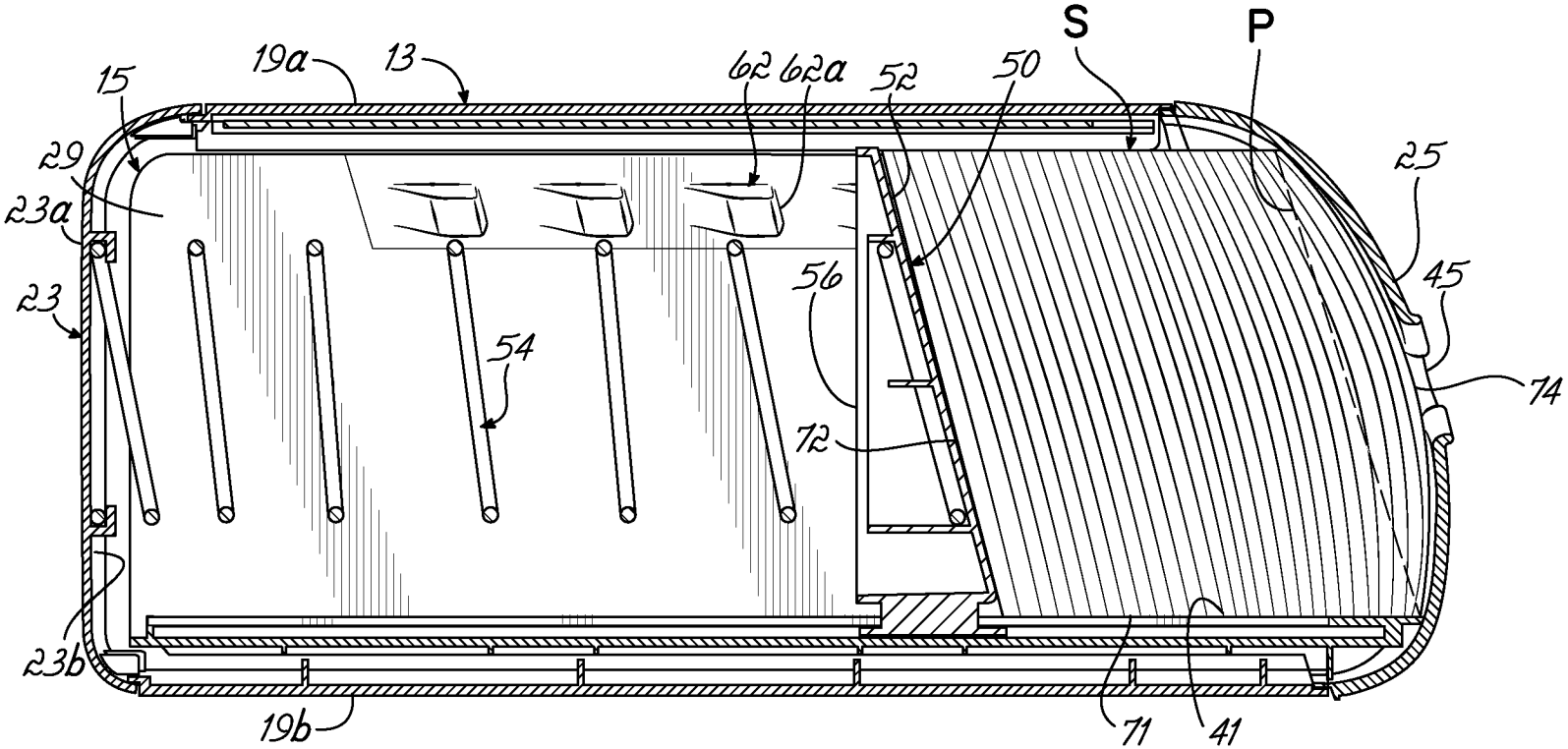
FIG. 7F is a view similar to FIGS. 7A-7E, showing the drawer in the closed position.
Figure 7G:
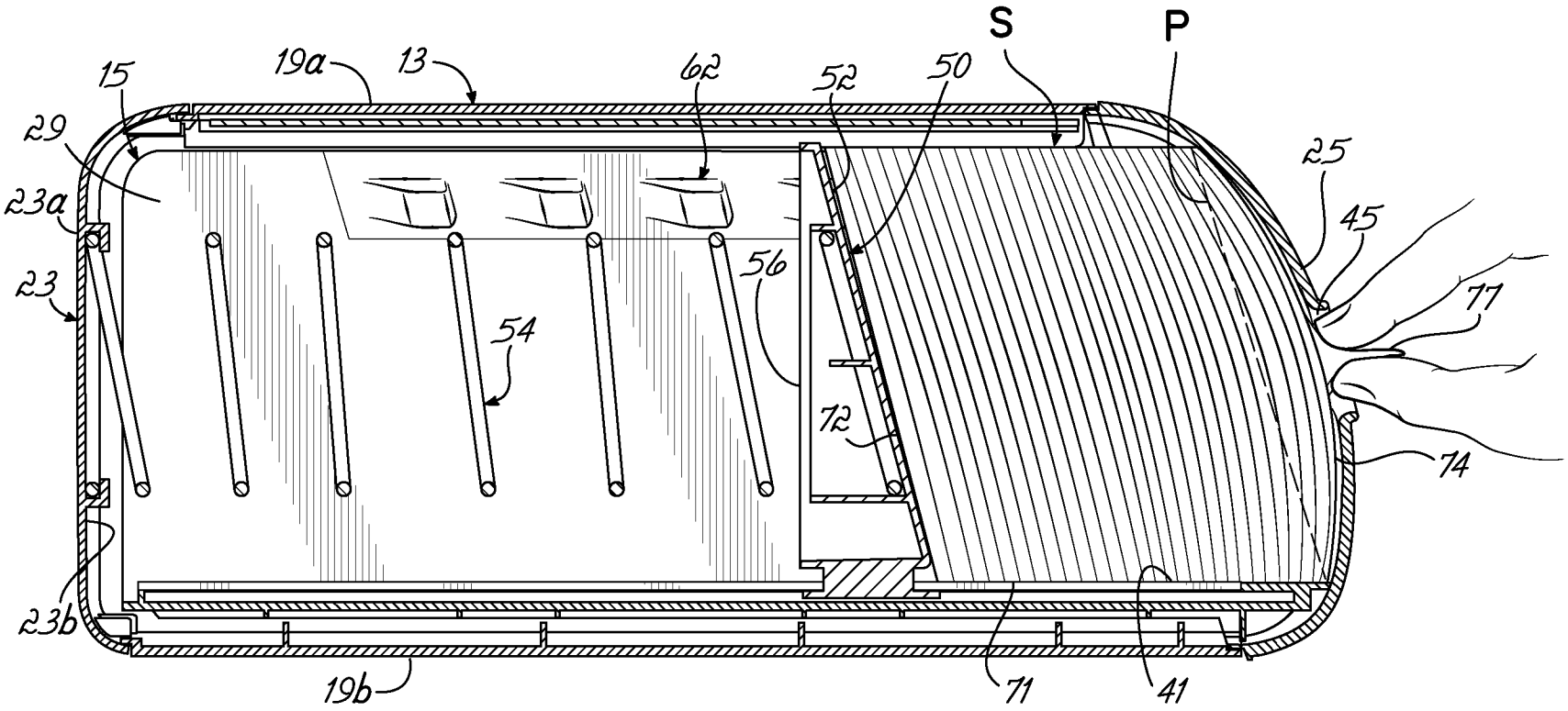
FIG. 7G is a view similar to FIGS. 7A-7F, showing extension of a portion of a napkin through a dispensing aperture of the dispenser.
Figure 7H:
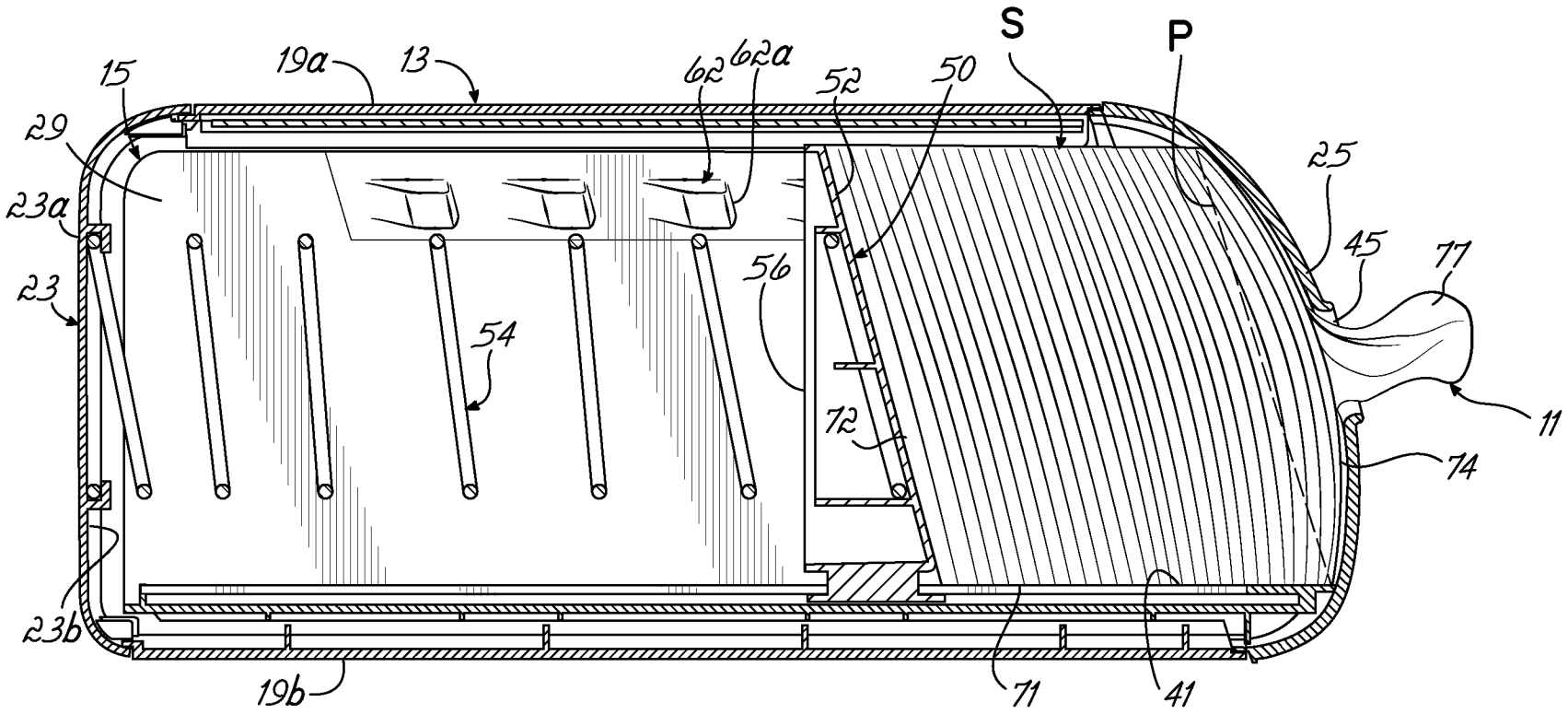
FIG. 7H is a view similar to FIGS. 7A-7G, showing napkins in the interior of the dispenser being ready for dispensing through the dispensing aperture.

With continued particular reference to FIGS. 5A-5C and 7A-7H, the user slides drawer 15 inwardly (in the general direction of arrows Q), toward the end wall 23, as seen in FIG. 7E, with that inward movement being effective to cause the paper-engaging surface 52 of platen 50 to engage back face 72 of the stack S. Further inward movement of drawer 15 causes that engagement to exert an outwardly-directed pressure against the stack S, toward front wall 25, by virtue of the action of the compression spring 54 as that spring is compressed by movement of platen 50 toward end wall 23. Once the drawer 15 is closed (FIG. 7F), the platen 50 continues to exert the outwardly-directed pressure against stack S. Advantageously, the type of pressure exerted by platen 50 on stack S is substantially uniform across the height and width of the stack S, thereby minimizing the concentration of pressure against any one of the edges defining dispensing aperture 45 of front wall 25. To that end, the paper-engaging surface 52 of platen 50 is maintained at a substantially constant oblique orientation (relative to bottom wall 41), during loading of stack S, as well as during dispensing of napkins 11 from stack S. Specifically, the oblique orientation of paper-engaging surface 52 substantially (e.g., within less than 30 degrees or even within as little as 5 degrees) matches the orientation of a theoretical plane P that circumscribes (includes) all four of the top and bottom junctures 37*a*, 37*b*, 39*a*, 39*b*. FIG. 7G shows the user extending a portion of an individual napkin 11 through the dispensing aperture 45, which leaves the napkins 11 in storage volume V ready for dispensing (FIG. 7H). The orientation of paper-engaging surface 52 may, in some example embodiments, be about 15 degrees from an imaginary vertical plane (not shown) i.e., about 105 degrees relative to bottom wall 41 (angle $\alpha$ in FIGS. 7A and 7B).

Figure 8A:
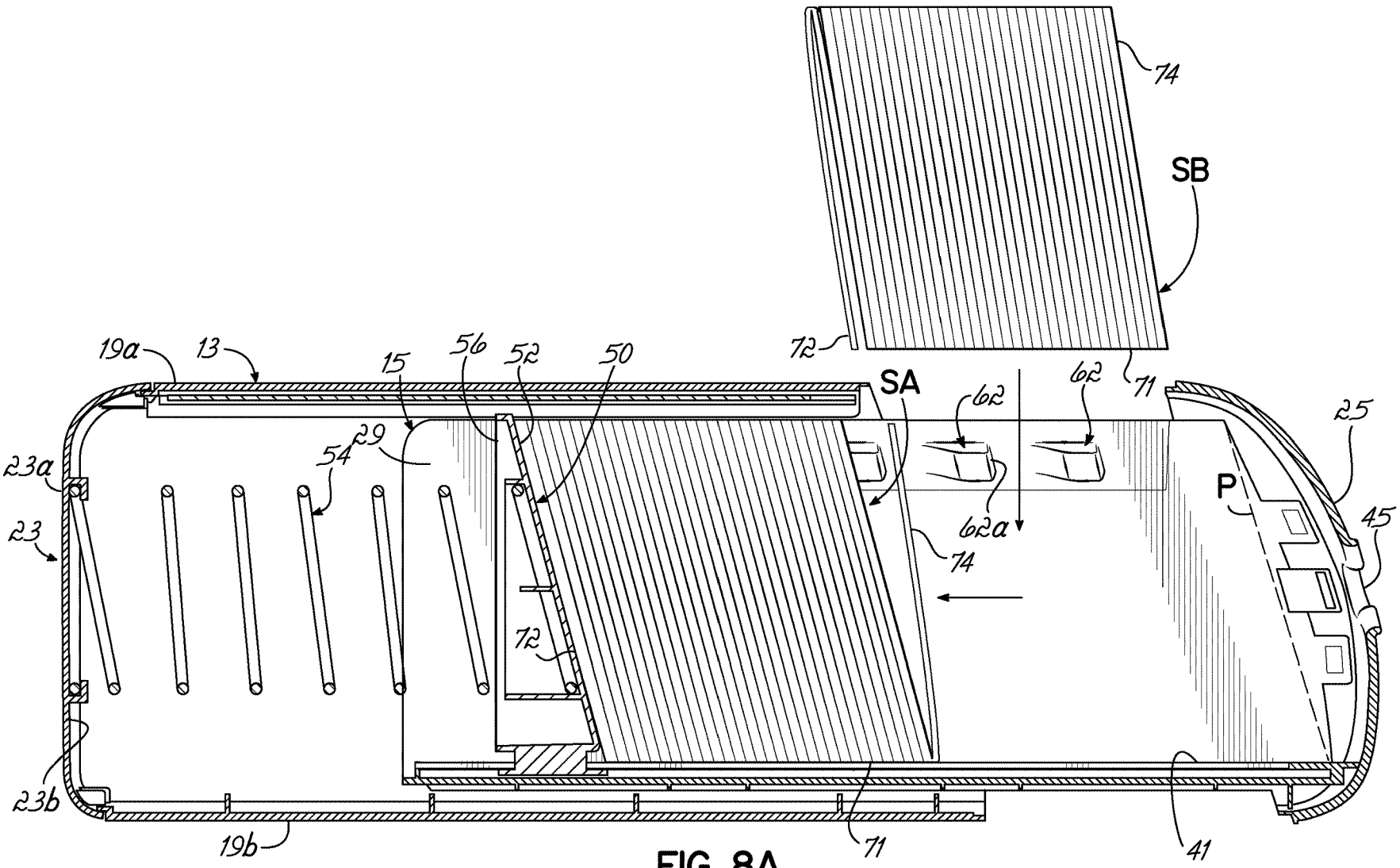
FIG. 8A is a view similar to FIGS. 7A-7H, showing an alternative embodiment of a method for loading napkins into the dispenser.
Figure 8B:
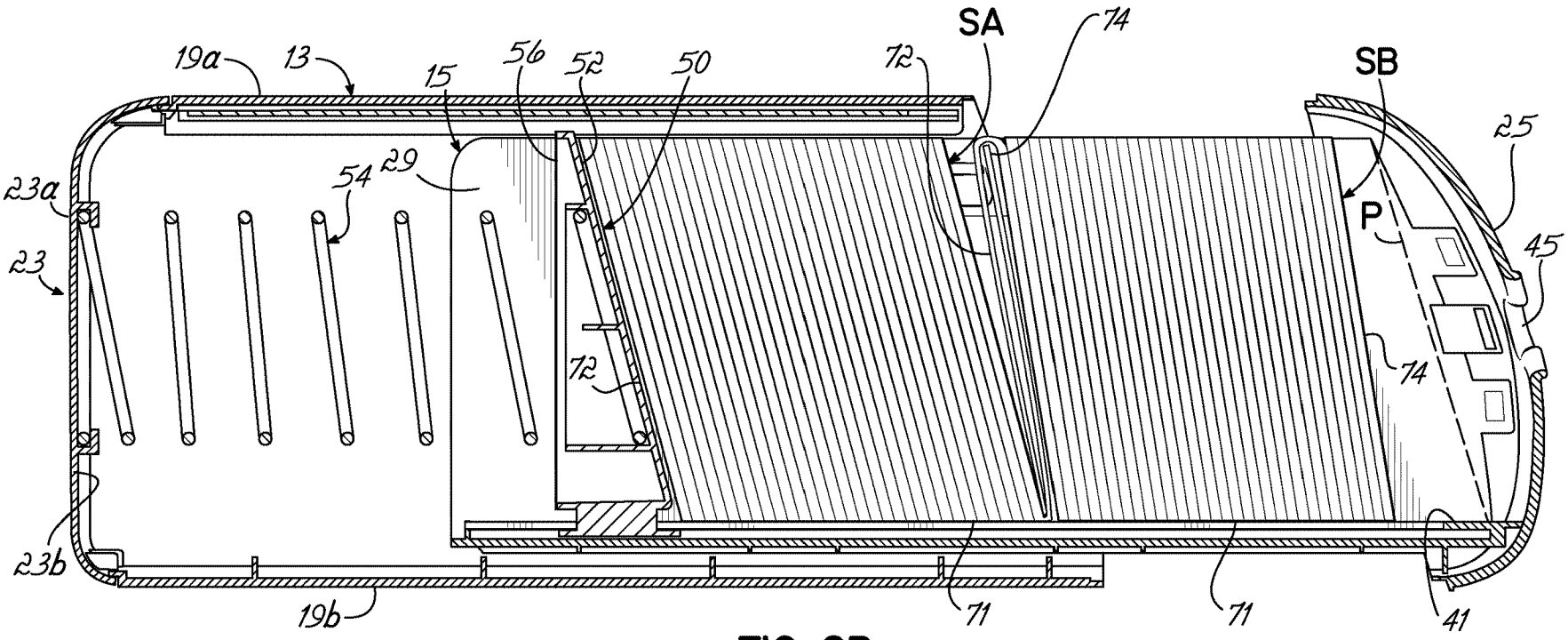
FIG. 8B is a view similar to FIG. 8A, showing another part of the method illustrated in FIG. 8A.

FIGS. 8A and 8B show two stacks SA, SB being loaded into storage volume V. FIG. 8B shows respective napkins in confronting faces of the two stacks SA, SB being manually interleaved with one another to allow uninterrupted dispensing during transitioning from the first to the second of the stacks. This is particularly useful for stacks S made up of interfolded napkins, in which dispensing of one napkin 11 through dispensing aperture 45 is effective to pull the next napkin 11 in the stack, one at a time, through frictional engagement between adjacent, interfolded napkins. Interleaving the napkins 11 in confronting faces of the two stacks permits that type of operation to continue as the napkins 11 of one stack (closest to the front wall 25) are depleted and the napkins 11 of the next stack S begin to be dispensed.

But the manual interleaving described above may be obviated altogether. In such case, upon depletion of the napkins of the first, foremost stack SB, the user may be able to easily pull the first napkin in the second stack SA through dispensing aperture 45. Specifically, the user may be able to pinch a gripping tab 77 of the first napkin of the second stack SA, if such gripping tab 77 is present, through a centrally located section ("central section") 80 of the dispensing aperture 45, and proceed to extend a portion of that first napkin through that dispensing aperture 45, thereby leaving the napkins of the second stack SA ready for dispensing.

Referring again to FIG. 3, the stack S in the illustrative embodiment of that figure is made up of napkins that are each Z-folded and in a number of about 120, although other types of folds and/or a different number of napkins are similarly contemplated. In one embodiment, the footprint area FA of that stack S is generally rectangular and may be such that the length LS and width WS of stack S do not exceed, respectively, about 115 mm and about 95 mm, which correspond to distances between interior surfaces defining storage volume V. Further, a height HS of the stack S may, for example, be no greater than about 110 mm. Those dimensions, as well as the type of fold and number of napkins in stack S described above have been found to provide enough stability to stack S for easy loading into dispenser 10, as well as provide for easy portability by an average adult human hand. Disadvantageously, however, the relatively small dimensions described above may also provide a perception of an insufficient amount of paper in each stack S, which lessens the overall perception of value of the dispensing system that comprises dispenser 10 and stacks S.

The example stack S of FIG. 3 has a generally rectangular cross-section such that the front face 74 (i.e., the top face of the stack in the orientation illustrated in the figure) defines a first pair of oppositely disposed, parallel surface edges S1, S2, and a second pair of oppositely disposed surface edges S3, S4, which are also parallel to one another and generally orthogonal to surface edges S1, S2. Stack S similarly includes a back face 72 (i.e., the bottom face of the stack in the orientation illustrated in the figure) disposed opposite front face 74. In the example stack S of FIG. 3, each of the napkins 11 is folded in such a manner that at least the front face 74 (and optionally the back face 72 as well) is provided with a generally linear griping tab 77 that is generally parallel to the second pair of surface edges S3, S4 and which extends between the first pair of surface edges S1, S2. In the illustrative stack S of the figures, the gripping tab 77 is located centrally between the second pair of surface edges S3, S4, although alternative stacks are contemplated in which the gripping tab 77 is not centrally located between surface edges S3, S4, or in which the gripping tab 77 has a shape other than that shown (e.g., a non-linear tab). Yet other alternative stacks are contemplated having no gripping tab 77 at all.

Figure 9:
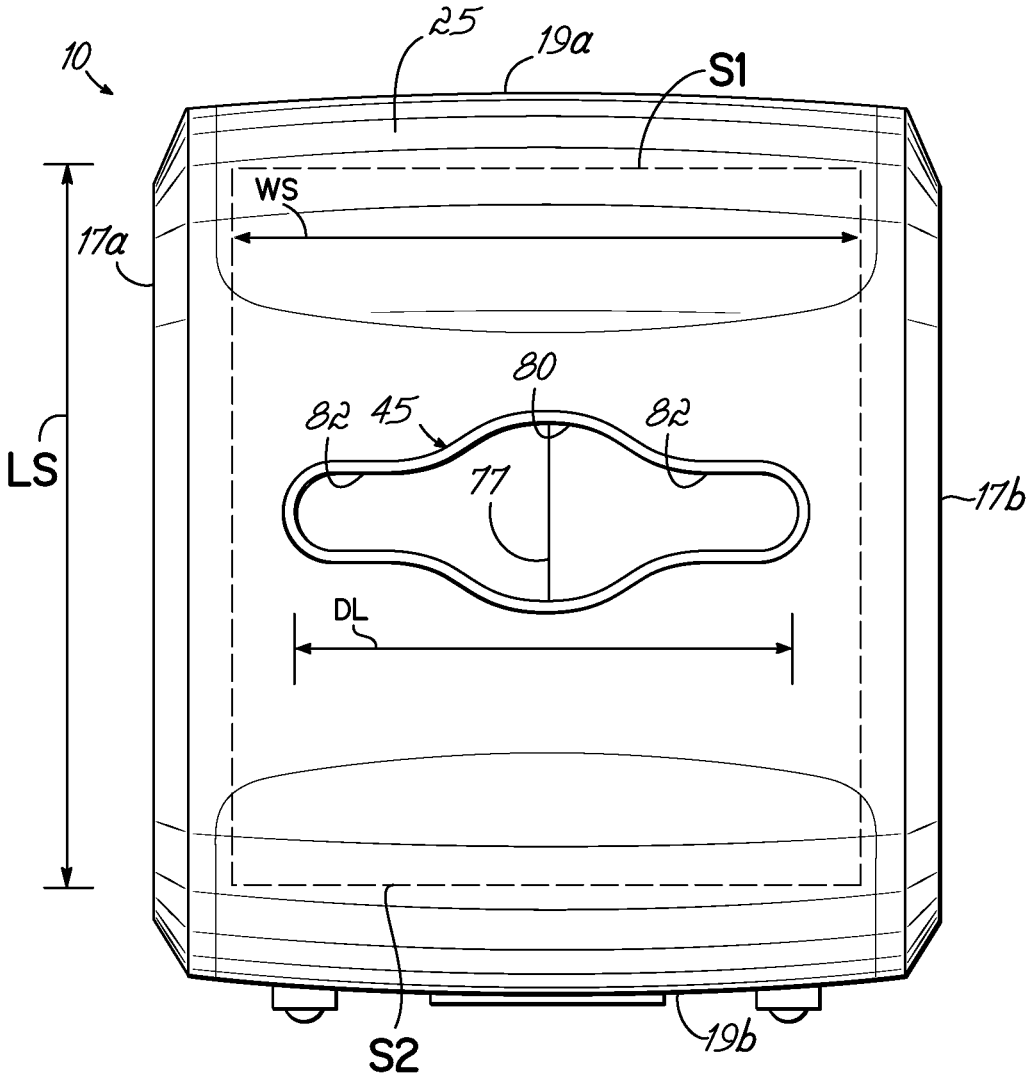
FIG. 9 is an elevation front view of the dispenser of FIGS. 1 and 2, showing a stack of napkins in the interior of the dispenser.
Figure 9A:
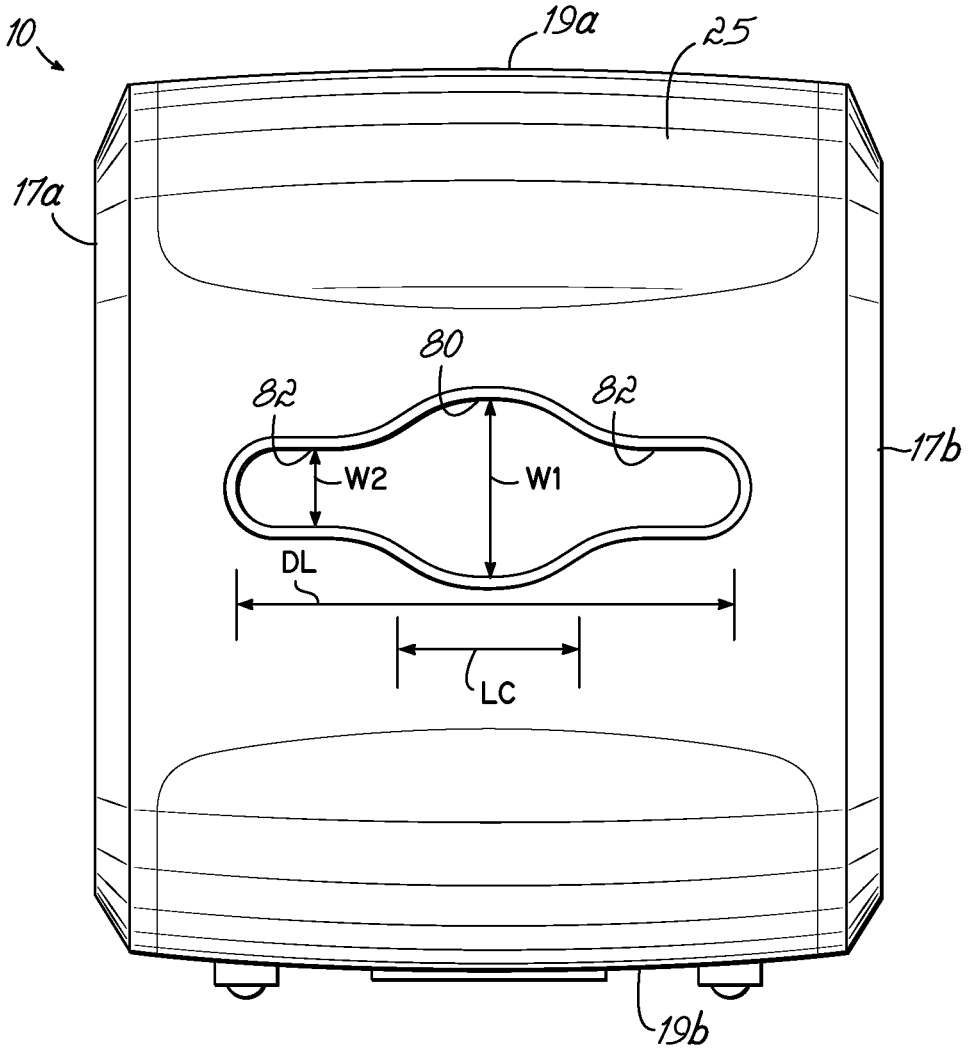
FIG. 9A is a view similar to FIG. 9, showing other features of the dispenser.

With continued particular reference to FIGS. 7A-7H and further referring to FIGS. 9 and 9A, the centralized location and shape of gripping tab 77 in the example stack S of the figures advantageously cooperate with the shape of dispensing aperture 45 to facilitate loading of the stack S into dispenser 10 for dispensing of the napkins 11 from stack S. Specifically, as described above, the user may be able to pinch the gripping tab 77 using the thumb and forefinger, and extend the gripping tab 77 through the dispensing aperture 45 toward the exterior, thereby making the napkins 11 available for dispensing (FIGS. 7G and 7H). To that end, the stack S may be loaded into storage volume V in an orientation such that the longitudinal dimension of gripping tab 77 is oriented transversely to the length dimension of dispensing aperture 45, as shown in FIG. 9. The shape and dimensions of dispensing aperture 45 are configured for that type of operation, thereby favoring stacks with a gripping tab—if one is present in the stack S—shaped and located as in the illustrated embodiment, while at least hindering the loading of stacks S having no gripping tab 77 at all or having a gripping tab located outside of the contours of central section 80 of dispensing aperture 45.

Referring particularly to FIG. 9A, each of a pair of slotted sections 82 extending from central section 80 has a width W2 that the inventors have found to be sufficiently narrow to prevent the average human adult forefinger and thumb from entering those slotted sections 82. The width W2 of the slotted sections may for example be no greater than about 13 mm, and more specifically about 12 mm, and in some embodiments between about 10 and about 11 mm. The relatively small width W2 prevents an average-sized adult human forefinger and thumb from accessing the surface of front face 74 of stack S, which minimizes the likelihood of contamination of the stack S, yet allows each napkin to protrude ready for dispensing in a semi-opened state, as shown in FIG. 7H, for example. The relatively small width W2 of the slotted sections 82, additionally, makes it difficult for the foremost napkin 11 in the stack S to be grabbed and pulled through dispensing aperture 45, unless that napkin 11 is grabbed through the central section 80. To that end, the absence of a gripping tab 77, particularly in stacks S having napkins of high friction value, creates difficulty in the ability to grab the foremost napkin 11 and extend at least a portion of that napkin through aperture 45. Napkins with a relatively low friction value, conversely, may not require a gripping tab at all, insofar as the topmost napkin 11 may be easy to slide relative to adjacent napkins, thereby allowing the user to grab that topmost napkin and extend at least a portion of that napkin through dispensing aperture 45.

Other aspects of the shape of dispensing aperture 45 are similarly designed to provide specific advantages to embodiments having such shape of dispensing aperture. For example, the overall length DL of the dispensing aperture 45 (i.e., the dimension generally extending between lateral walls 17*a*, 17*b*) is configured to be less than the expected width WS of the stack S (i.e., the dimension of the stack parallel to the length dimension of the dispensing aperture 45). That feature forces the foremost napkin 11 protruding through dispensing aperture 45 to bend slightly, thereby attaining an erect attitude, ready for manual withdrawal, as shown in FIG. 7H. The overall length DL of dispensing aperture 45, for example, may be about 77 mm, which is a dimension suitable for stacks having a width WS of about 84 mm—with that combination of dimensions having been found to facilitate an erect attitude of certain types of napkins 11 through dispensing aperture 45, while allowing for smooth, consistent dispensing of those napkins 11. The precise suitable combination of length DL and width WS may depend on the friction value of the napkins 11.

Additionally, the length LC and width W1 of the central section 80 are configured to allow an average adult human thumb and forefinger to pinch the gripping tab 77, in the manner shown in FIG. 7G, while minimizing the overall area of that central section 80. In that regard, the length LC of central section 80 may for example be no greater than about 40 mm, while the width W1 of that central section 80 may for example be no greater than about 30 mm. Minimization of the overall area of central section 80, in turn, advantageously minimizes exposure of the napkins 11 in storage volume V to the exterior through dispensing aperture 45, which in turn reduces the likelihood of contamination of those napkins 11. A disadvantage of the relative small size of central section 80, however, is that it may impede or at least hinder the pinching or otherwise grabbing of a portion of the foremost napkin 11 in the stack S during loading, and specifically during preparation of the stack S for dispensing, particularly—for example—for persons having above-average sized fingers.

From the above disclosure of the general principles of the present invention and the preceding detailed description of exemplifying embodiments, those skilled in the art will readily comprehend the various modifications to which this invention is susceptible. Accordingly, this invention is intended to be limited only by the scope of the following claims and equivalents thereof.

What is claimed is:

1. A napkin dispenser comprising:

a casing including a plurality of outer walls extending in a longitudinal direction and an end wall extending orthogonally between said outer walls and jointly defining a close-ended generally tubular structure;

a drawer having a pair of oppositely disposed sidewalls, a bottom wall extending between said sidewalls, and a front wall joining said sidewalls and bottom wall, said pair of sidewalls, bottom wall, and front wall jointly defining a storage volume of said drawer, said drawer being configured for releasable coupling with said casing and configured for selective slidable movement into and out of said casing, said front wall including a dispensing aperture;

a platen disposed in said drawer, said platen having a paper-engaging surface for engaging a stack of napkins stored in said storage volume of said drawer; and a biasing element coupled to said platen and configured to urge said platen toward said front wall, said platen being disposed in said drawer so as maintain said paper-engaging surface in an orientation oblique relative to said bottom wall of said drawer during slidable movement of said drawer relative to said casing, wherein said sidewalls of said drawer include a first sidewall including a first plurality of tabs disposed along a top region of said first sidewall, and a second sidewall including a second plurality of tabs disposed along a top region of said first sidewall, the first plurality of tabs on the first sidewall being offset in the longitudinal direction with respect to the second plurality tabs on the second sidewall to define a staggered configuration of the first and second plurality of tabs, said plurality of tabs configured to support the stack of napkins in the longitudinal direction and hinder pivotal movement of the stack of napkins away from said front wall, a remainder of each of said sidewalls being free of tabs, wherein each tab included in the first plurality of tabs is spaced apart from one another by a portion of the first sidewall, and each tab included in the second plurality of tabs is spaced apart from one another by a portion of the second sidewall, and wherein each of said plurality of tabs includes a slanted surface facing said end wall and configured to permit unhindered forward movement of the stack of napkins toward said front wall and said dispensing aperture.

2. A napkin dispenser comprising:

a casing including a plurality of outer walls extending in a longitudinal direction and an end wall extending orthogonally between said outer walls and jointly defining a close-ended generally tubular structure;

a drawer having a pair of oppositely disposed sidewalls, a bottom wall extending between said sidewalls, and a front wall joining said sidewalls and bottom wall, said pair of sidewalls, bottom wall, and front wall jointly defining a storage volume of said drawer, said drawer being configured for releasable coupling with said casing and configured for selective slidable movement into and out of said casing, said front wall including a dispensing aperture;

a platen disposed in said drawer, said platen having a paper-engaging surface for engaging a stack of napkins stored in said storage volume of said drawer; and a biasing element coupled to said platen and configured to urge said platen toward said front wall, said platen being disposed in said drawer so as maintain said paper-engaging surface in an orientation oblique relative to said bottom wall of said drawer during slidable movement of said drawer relative to said casing, wherein said plurality of outer walls of said casing include a pair of oppositely disposed lateral walls, said lateral walls of the casing each having a respective hook, wherein said drawer includes a pair of locking tabs cooperating respectively with said hooks so that said drawer is released for sliding movement of said drawer relative to said casing upon inward pushing on a pair of oppositely disposed end portions of said lateral walls so as to disengage said respective hooks from said pair of locking tabs, wherein said oppositely disposed sidewalls of said drawer are positioned inwardly of said respective hooks, wherein said sidewalls of said drawer include a first sidewall including a first plurality of tabs disposed along a top region of said first sidewall, and a second sidewall including a second plurality of tabs disposed along a top region of said first sidewall, the first plurality of tabs on the first sidewall being offset in the longitudinal direction with respect to the second plurality tabs on the second sidewall to define a staggered configuration of the first and second plurality of tabs, wherein the plurality of tabs configured to support the stack of napkins in the longitudinal direction and hinder pivotal movement of the stack of napkins away from said front wall, a remainder of each of said sidewalls being free of tabs, wherein each tab included in the first plurality of tabs is spaced apart from one another by a portion of the first sidewall, and each tab included in the second plurality of tabs is spaced apart from one another by a portion of the second sidewall, and wherein each of said plurality of tabs includes a slanted surface facing said end wall and configured to permit unhindered forward movement of the stack of napkins toward said front wall and said dispensing aperture.

3. The napkin dispenser of claim 2, wherein said end wall has an arcuate outer surface configured to cause the dispenser to wobble if the dispenser is stood on said arcuate outer surface.

4. The napkin dispenser of claim 3, wherein said arcuate outer surface of said end wall is shaped to cause the dispenser to wobble only along one dimension.

5. The napkin dispenser of claim 2, wherein:

said front wall of said drawer is arcuate, and said oblique orientation of said paper-engaging surface relative to said bottom wall is substantially the same as an orientation of a plane circumscribing respective top and bottom junctures of said arcuate front wall with said sidewalls.

6. The napkin dispenser of claim 2, wherein said oblique orientation is such that said paper-engaging surface defines an angle of about 105 degrees relative to said bottom wall of said drawer.

7. A napkin dispenser, comprising:

a casing including a plurality of outer walls extending in a longitudinal direction;

a drawer including a pair of oppositely disposed sidewalls, the drawer configured for releasable coupling with said casing and configured for selective slidable movement into and out of said casing;

a front wall extending between said outer walls and having a dispensing aperture; and an end wall disposed opposite said front wall and orthogonally between said outer walls and jointly defining a close-ended generally tubular structure, wherein:

said outer walls, front wall, and end wall jointly define a storage volume of the dispenser for storing a stack of napkins therein, said dispensing aperture is shaped to permit extraction of napkins from the stack in the storage volume, and said end wall has an arcuate outer surface configured to cause the dispenser to wobble if the dispenser is stood on said arcuate outer surface, wherein said plurality of outer walls of said casing include a pair of oppositely disposed lateral walls, said lateral walls of the casing each having a respective hook, wherein said drawer includes a pair of locking tabs cooperating respectively with said hooks so that said drawer is released for sliding movement of said drawer relative to said casing upon inward pushing on a pair of oppositely disposed end portions of said lateral walls so as to disengage said respective hooks from said pair of locking tabs, wherein said oppositely disposed sidewalls of said drawer are positioned inwardly of said respective hooks, wherein said sidewalls of said drawer include a first sidewall including a first plurality of tabs disposed along a top region of said, first sidewall, and a second sidewall including a second plurality of tabs disposed along a top region of said first sidewall, the first plurality of tabs on the first sidewall being offset in the longitudinal direction with respect to the second plurality tabs on the second sidewall to define a staggered configuration of the first and second plurality of tabs, the plurality of tabs configured to support the stack of napkins in the longitudinal direction and hinder pivotal movement of the stack of napkins away from said front wall, a remainder of each of said sidewalls being free of tabs, wherein each tab included in the first plurality of tabs is spaced apart from one another by a portion of the first sidewall, and each tab included in the second plurality of tabs is spaced apart from one another by a portion of the second sidewall, and wherein each of said plurality of tabs includes a slanted surface facing said end wall and configured to permit unhindered forward movement of the stack of napkins toward said front wall and said dispensing aperture.

8. The napkin dispenser of claim 7, wherein said arcuate outer surface of said end wall is shaped to cause the dispenser to wobble only along one dimension if the dispenser is stood on said arcuate outer surface.

9. The napkin dispenser of claim 7, wherein said arcuate outer surface has a radius of curvature greater than about 350 degrees.

10. A napkin dispensing system comprising:

a dispenser for storing and dispensing individual napkins from a stack thereof, said dispenser having:

(a) a casing including a plurality of outer walls extending in a longitudinal direction and an end wall extending orthogonally between said outer walls and jointly defining a close-ended generally tubular structure, (b) a drawer having a pair of oppositely disposed sidewalls, a bottom wall extending between said sidewalls, and an arcuate front wall having a dispensing aperture and joining said sidewalls and bottom wall, said pair of sidewalls, bottom wall, and arcuate front wall jointly defining a storage volume of said drawer, said drawer being configured for releasable coupling with said casing and configured for selective slidable movement into and out of said casing, (c) a platen disposed in said drawer, said platen having a substantially flat paper-engaging surface for engaging a stack of napkins stored in said storage volume of said drawer, and (d) a biasing element coupled to said platen and configured to urge said platen toward said front wall, said platen being disposed in the drawer so as maintain said substantially flat paper-engaging surface in a substantially constant oblique orientation relative to said bottom wall of said drawer during slidable movement of said drawer relative to said tubular structure, the oblique orientation being substantially the same as an orientation of a plane circumscribing respective top and bottom junctures of the arcuate front wall with the side walls, said plane being also oblique relative to the bottom wall of the drawer; and a stack of interfolded napkins in said storage volume of said drawer, said stack having a generally rectangular footprint, said rectangular footprint including a length not exceeding about 115 mm and a width not exceeding about 95 mm, wherein:

said dispensing aperture has an elongated shape and includes a length dimension and a width dimension, said dispensing aperture has a centrally located section and a pair of slotted sections each extending from said centrally located section, said centrally located section has a length no greater than about 40 mm, and each of said slotted sections has a width no greater than about 13 mm, wherein said plurality of outer walls of said casing include a pair of oppositely disposed lateral walls, said lateral walls of the casing each having a respective hook, wherein said drawer includes a pair of locking tabs cooperating respectively with said hooks so that said drawer is released for sliding movement of said drawer relative to said casing upon inward pushing on a pair of oppositely disposed end portions of said lateral walls so as to disengage said respective hooks from said pair of locking tabs, wherein said oppositely disposed sidewalls of said drawer are positioned inwardly of said respective hooks, wherein said sidewalls of said drawer include a first sidewall including a first plurality of tabs disposed along a top region of said first sidewall, and a second sidewall including a second plurality of tabs disposed along a top region of said first sidewall, the first plurality of tabs on the first sidewall being offset in the longitudinal direction with respect to the second plurality tabs on the second sidewall to define a staggered configuration of the first and second plurality of tabs, said plurality of tabs configured to support the stack of napkins in the longitudinal direction and hinder pivotal movement of the stack of napkins away from said front wall, a remainder of each of said sidewalls being free of tabs, wherein each tab included in the first plurality of tabs is spaced apart from one another by a portion of the first sidewall, and each tab included in the second plurality of tabs is spaced apart from one another by a portion of the second sidewall, and wherein each of said plurality of tabs includes a slanted surface facing said end wall and configured to permit unhindered forward movement of the stack of napkins toward said front wall and said dispensing aperture.

11. The napkin dispensing system of claim 10, wherein said end wall has an arcuate outer surface configured to cause said dispenser to wobble if said dispenser is stood on said arcuate outer surface.

12. The napkin dispensing system of claim 11, wherein said arcuate outer surface of said end wall is shaped to cause said dispenser to wobble only along one dimension if said dispenser is stood on said arcuate outer surface.

13. The napkin dispensing system of claim 11, wherein said arcuate outer surface of said end wall has a radius of curvature greater than about 350 degrees.

* * * * *